US006568669B2

(12) United States Patent
Hosaka

(10) Patent No.: US 6,568,669 B2
(45) Date of Patent: May 27, 2003

(54) SHEET POST-PROCESSING APPARATUS

(75) Inventor: Masato Hosaka, Yamanashi-ken (JP)

(73) Assignee: Nisca Corporation, Yamanashi-ken (JP)

( * ) Notice: Subject to any disclaimer, the term of this patent is extended or adjusted under 35 U.S.C. 154(b) by 65 days.

(21) Appl. No.: 09/984,187

(22) Filed: Oct. 29, 2001

(65) Prior Publication Data

US 2002/0050681 A1 May 2, 2002

(30) Foreign Application Priority Data

Oct. 31, 2000 (JP) ..... 2000-331786

(51) Int. Cl.[7] ..... B65H 45/04

(52) U.S. Cl. ..... 270/58.12; 270/58.16; 270/58.17; 227/100; 227/4; 399/410

(58) Field of Search ..... 270/58.08, 58.11, 270/58.12, 58.16, 58.17; 399/410; 227/4, 39, 100, 101

(56) References Cited

U.S. PATENT DOCUMENTS 4,988,030 A * 1/1991 Muramatu et al. ..... 227/27
5,114,130 A * 5/1992 Hamanaka et al. ..... 270/58.11
5,799,935 A * 9/1998 Yamanushi et al. ..... 270/58.08
5,931,460 A * 8/1999 Kadowaki et al. ..... 271/220
6,171,225 B1 * 1/2001 Nonoyama et al. ..... 493/16
6,223,965 B1 * 5/2001 Nakatsuka ..... 227/111
6,290,220 B1 * 9/2001 Takehara et al. ..... 270/58.12

FOREIGN PATENT DOCUMENTS

JP 7-157180 A * 6/1995
JP 7-187479 A * 7/1995
JP 8-192951 A * 7/1996
JP 10-218474 A * 8/1998
JP 2000-63031 A * 2/2000

* cited by examiner

*Primary Examiner*—Patrick H. Mackey
(74) *Attorney, Agent, or Firm*—Kanesaka & Takeuchi

(57) ABSTRACT

A sheet post-processing apparatus includes a head unit and an anvil unit movably disposed in a direction traversing the sheet discharge direction to provide staples into a sheet bundle. A feed path is disposed between the head unit and the anvil unit for allowing the sheet bundle to pass therethrough. The sheet bundle is moved from a stacking device to the feed path, wherein the head unit and anvil unit stitch the sheet bundle fed for a specified distance into the feed path.

12 Claims, 30 Drawing Sheets

SHEET POST-PROCESSING APPARATUS

BACKGROUND OF THE INVENTION AND RELATED ART STATEMENT

The present invention relates to a sheet post-processing apparatus for binding sheets or a bundle of sheets, and an image forming apparatus, such as a copier, a printer or a facsimile device equipped with the post-processing apparatus.

A previous sheet post-processing apparatus that performs a saddle stitching, such as disclosed in Japanese Patent Publication (KOKAI) No. 8-301512, comprises a stopper to position a sheet bundle in the sheet feeding direction, which moves to an operating position and to a retracted position.

Problems, such as large size and high cost, occur in the previous sheet post-processing apparatus because they require dedicated drive sources, such as solenoids, to move the stopper to the operating position and the retracted position.

There are also other problems related to the conventional sheet post-processing apparatus, such as the problem of long processing time, because the feeding of the sheet bundle and the moving of the stitching means are controlled in respectively different time frames.

In view of the foregoing problems, it is an object of the present invention to provide a compact and low-cost sheet post-processing apparatus and an image forming apparatus equipped with the sheet post-processing apparatus built therein.

SUMMARY OF THE INVENTION

The present invention is composed of the following structure in order to attain the above-described objects. Briefly, the foregoing object is accomplished in accordance with the present invention for the sheet post-processing apparatus, which comprises stacking means for stacking sheets discharged sequentially out of an image forming apparatus; at least one leading edge restricting member movable between a restricting position to restrict a leading edge of a sheet discharged to the stacking means in a sheet discharge direction and a retracted position to retract from the restricting position; a head unit movably disposed in a direction traversing the sheet discharge direction to drive staples into a sheet bundle; an anvil unit opposingly arranged to the head unit and movingly disposed in a direction traversing the sheet discharge direction to receive and bend staples driven from the head; a feed path disposed between the head unit and the anvil unit for allowing the sheet bundle to pass therethrough; and feeding means for feeding sheet bundles from the stacking means to the feed path.

The head unit and the anvil unit stitch sheet bundles are moved for a specific distance into the feed path by the feeding means. The apparatus further includes means for moving the at least one leading edge restricting member from the restricting position to the retracted position or from the retracted position to the restricting position by moving at least one of the head unit and the anvil unit in a direction traversing the sheet discharge direction.

Also, the foregoing object is accomplished in accordance with the present invention by the sheet post-processing apparatus, which comprises stacking means for stacking sheets discharged sequentially out of an image forming apparatus; at least one leading edge restricting member movable between a restricting position to restrict a leading edge of a sheet discharged to the stacking means in a sheet discharge direction and a retracted position retracted from the restricting position; a head unit movably disposed in a direction traversing the sheet discharge direction to drive staples into a sheet bundle; an anvil part opposingly arranged to the head unit and movingly disposed in a direction traversing the sheet discharge direction to receive and bend the staples driven from the head; a feed path disposed between the head unit and the anvil unit for allowing the sheet bundle to pass therethrough; and feeding means for feeding the sheet bundle from the stacking means to the feed path.

The head unit and the anvil unit stitch the sheet bundle fed for a specific distance into the feed path by the feeding means. The apparatus also includes sheet discharge means for discharging the sheet bundle stitched by the head unit and the anvil unit from between the head unit and the anvil unit. A time frame in which at least one of the feeding means and the sheet discharge means feeds the sheet bundle, and a time frame in which at least one of the head unit and the anvil unit move in the direction traversing the sheet discharge direction overlap with each other.

DETAILED DESCRIPTION OF PREFERRED EMBODIMENTS

The following describes in detail embodiments of the sheet post-processing apparatus according to the present invention in reference to the drawings provided.

Figure 1:
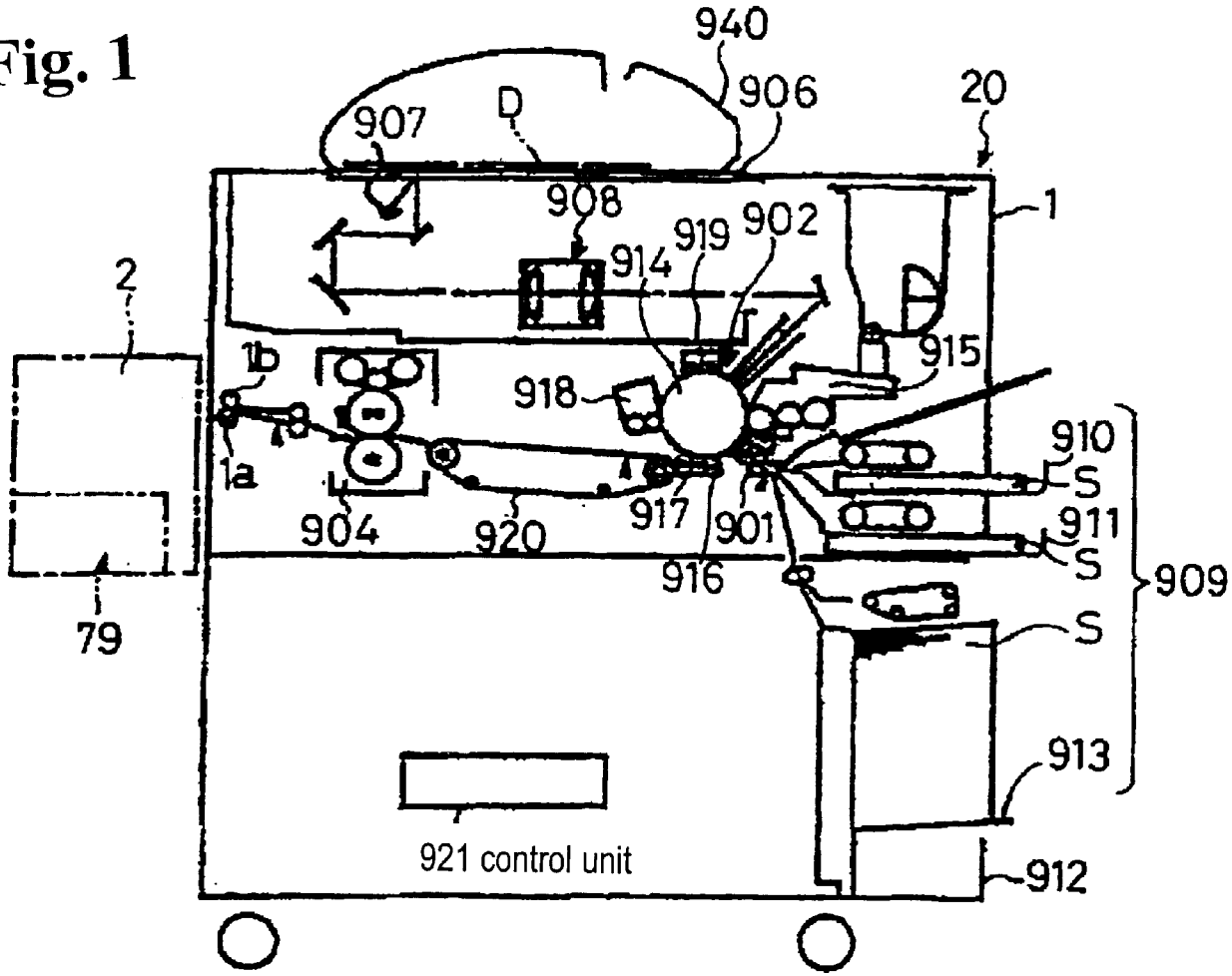
FIG. 1 is a front cross-sectional view for a copier having a folded sheet stacking device built in a main body thereof.

FIG. 1 illustrates a main body of a copier that is an example of an image forming apparatus provided with a sheet post-processing apparatus according to the present invention. In the figure, the main body 1 of the copier 20 comprises a platen glass 906 used as an original table, a light source 907, a lens system 908, a sheet feeder 909, and an image forming section 902. The main body 1 is equipped with an automatic document feeder 940 thereon for automatically feeding an original D to the platen glass 906.

The sheet feeder 909 has cassettes 910 and 911 mountable to the main body 1 for storing recording sheets S and a deck 913 disposed on a pedestal 912. The image forming section (image forming means) 902 is equipped with a cylindrical photo-conductor drum 914 and arranged thereabout are a developer 915, a transfer charger 916, a separation charger 917, a cleaner 918, and a primary charger 910. Downstream of the image forming section 902, there are arranged a feeding apparatus 920, a fixing device 904, and paired discharge rollers 1*a* and 1*b*.

The following describes operations of the mechanisms inside the main body 1 of the copier 20. When a paper feed signal is output from the control unit 921 disposed in the main body 1, the sheet S is fed out of the cassette 910 or 911, or the deck 913. The light source 907 generates light to the document D on the platen glass 906. The light is reflected by a document D and irradiated through the lens system 908 to the photo-conductor drum 914. The photo-conductor drum 914 is charged in advance by the primary charger 910 and has an electrostatic latent image formed thereon by the light irradiated thereto. In turn, the photo-conductor drum 914 has the electrostatic latent image developed to form a toner image by the developer 915.

The sheet S fed from the sheet feeder 909 is skew-corrected and timing-adjusted by a register roller 901 before being fed to the image forming section 902. On the image forming section 902, the transfer charger 916 transfers the toner image on the photo-conductor drum 914 to the sheet S fed therein. The sheet S having the toner image transferred thereto is charged to a polarity reverse to the transfer electrode 916 by the separating charger 917 before being separated from the photo-conductor drum 914.

The separated sheet S is fed to the fixing unit 904 by the feeding apparatus 920. The fixing unit 904 permanently fixes the transferred image onto the sheet S. The sheet S having the image fixed thereon is discharged out by the paired discharge rollers 1*a* and 1*b*. The sheet S fed from the sheet feeder 909 in this way has the image formed thereon and is discharged to the sheet post-processing apparatus 2.

Figure 2:
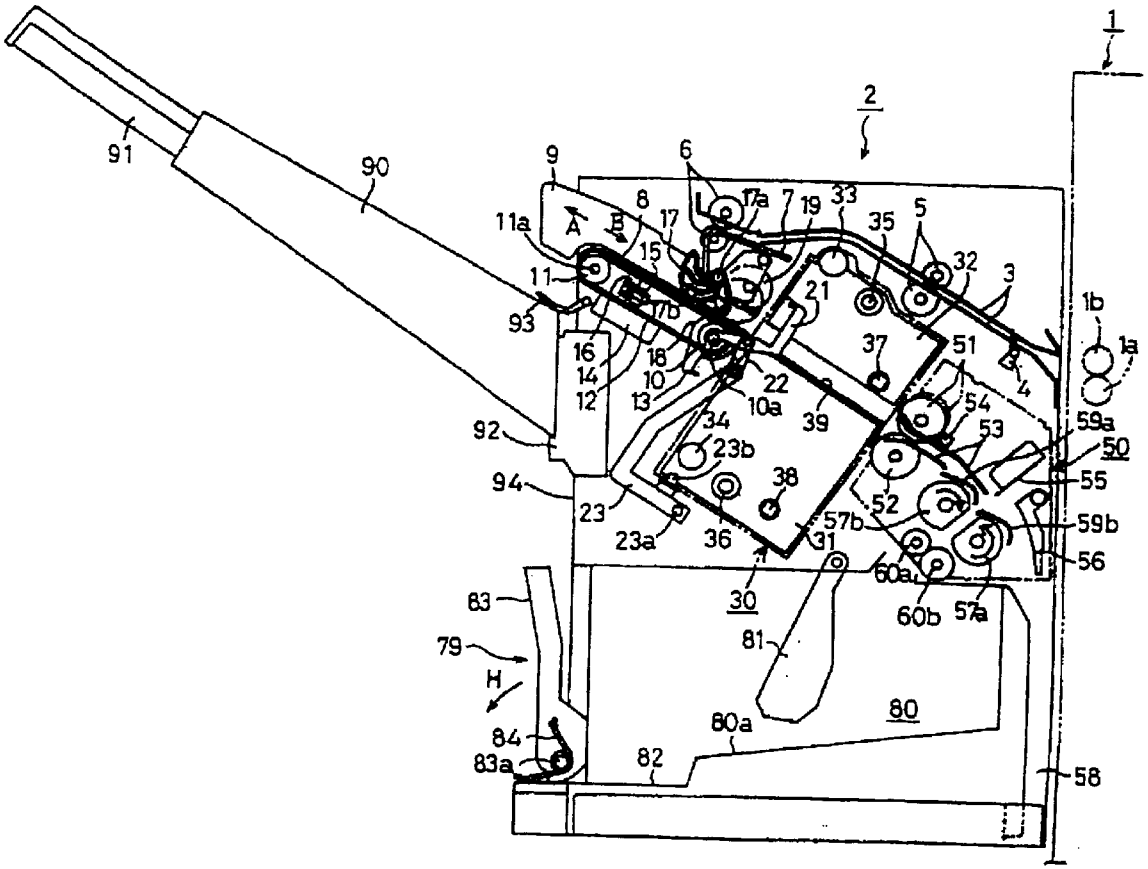
FIG. 2 is a front cross-sectional view for a sheet post-processing apparatus having the folded sheet stacking device built therein.

FIG. 2 illustrates the sheet post-processing apparatus, also referred to as a "finisher", 2 that is disposed on the side of the main body 1 of a copier.

The discharge roller 1*a* and the discharge roller 1*b* pressed to the discharge roller 1*a* equipped on the main body 1 of the copier 20 form the paired discharge rollers. Paired feed guides 3 receive the sheet discharged from the paired discharge rollers 1*a* and 1*b*, and guide the sheet into the sheet post-processing apparatus 2. A sheet detecting sensor 4 detects the sheet fed in the feed guide 3. Detecting the sheet by the sheet detecting sensor 4 serves to determine the timing for aligning and to signal whether or not the sheet has jammed inside of the feed guide 3. Paired discharge rollers 6 rotate to support the sheet in the feed guide 3 sandwiched therebetween to feed it.

Figure 3:
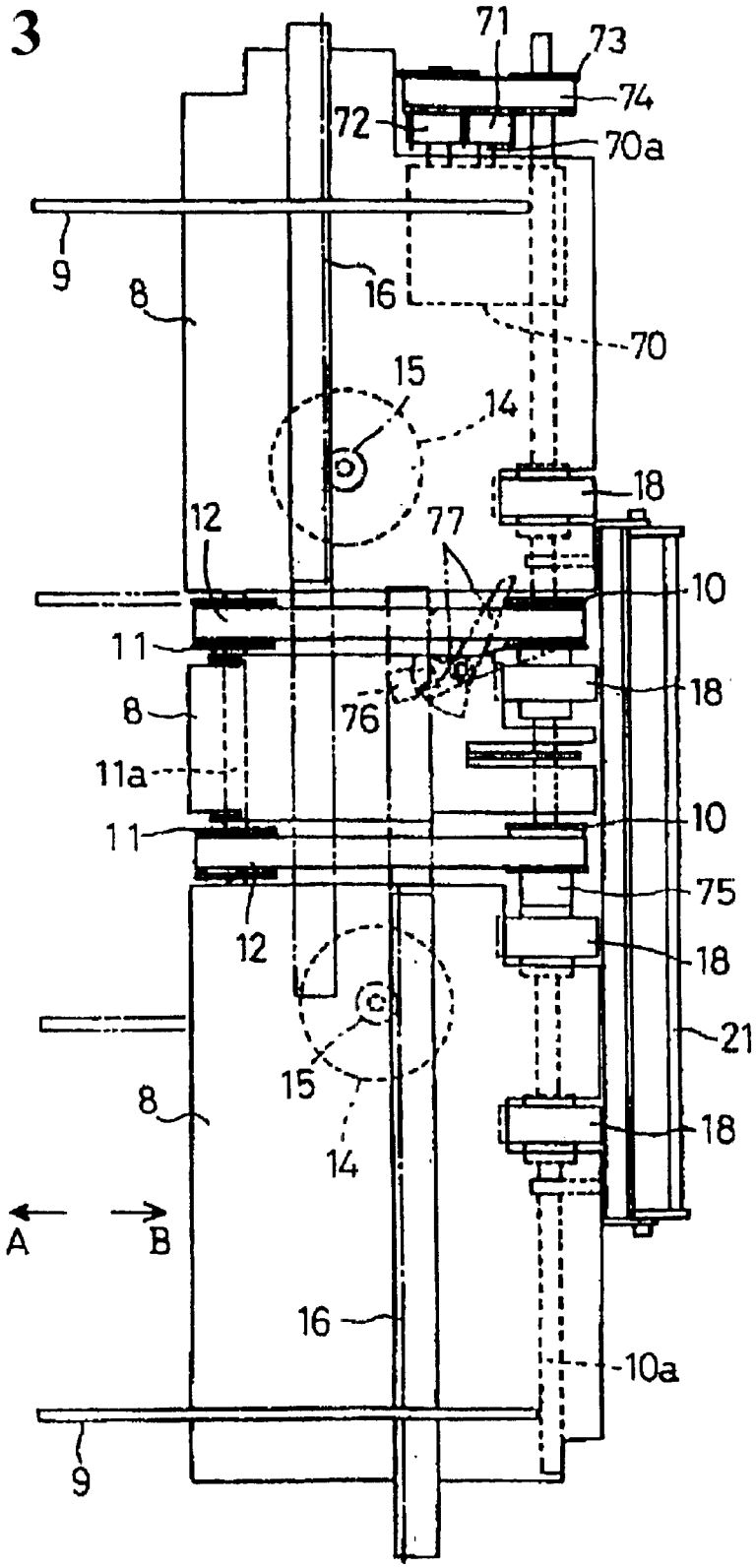
FIG. 3 is a plan view for a processing tray of the sheet post-processing apparatus.

The processing tray 8 receives the sheets discharged continuously by the paired discharge rollers 6 for stacking. Paired aligning plates 9 are disposed on the processing tray 8 to guide and align both of the edges of the sheet, i.e. width, discharged by the paired discharge rollers 6. Each of the aligning plates 9, as shown in FIG. 3, is arranged on a side of the respective edges in the width direction traversing the direction of the sheet fed. Each of the aligning plates 9 is meshed with a pinion 15 arranged on a shaft of one of aligning motors 14 formed of a stepping motor arranged below the processing tray 8. Racks 16 are integrated with the respective aligning plates 9 and disposed on the processing tray 8 to be moved appropriately in the with direction of the sheet by rotations of the front side aligning motor 14 and the rear side aligning motor 14. The racks 16 align the sheets based on the center in the width direction of each sheet discharged according to either type of the copier that discharges the sheets by aligning at the center in the width direction of each sheet, or the type that aligns either the right or left edge of each sheet, or a type that can align based on either the right or left edge in the width direction of each sheet.

The feed guide 7 shown in FIG. 2 is a guide for guiding into the processing tray 8 the sheets discharged out of the paired discharge rollers 6. A paddle 17 is situated below the feed guide 7. The paddle 17 is formed of a semicircular rubber having a fixed elasticity and designed to rotate with a center of a shaft 17*a* in contact with an upper surface of the sheet to securely feed the sheet. The paddle 17 also has a fin 17*b* extending radially with the center of the shaft 17*a* and a paddle surface 17*c* integrated into one unit. The paddle 17 is designed to easily deform as the sheets are stacked in the processing tray 8 so that the sheets can be fed properly.

The processing tray 8, as shown in FIG. 2, also has a first pulley 10 situated on a first pulley shaft 10*a* on one side thereof and has a second pulley 11 formed on a second pulley shaft 11*a* on the other side thereof. A feed belt 12 is disposed between the first pulley 10 and the second pulley 11. The feed belt 12 has a pressing pawl 13 on a part of the circumference of the feed belt 12.

The first pulley shaft 10*a* has a lower feed roller 18 mounted axially thereon. An upper feed roller 19 is located above the lower feed roller 18 to move between a position (dotted line in FIG. 2) where the upper feed roller 19 presses the lower feed roller 18, and a separating position (solid line in FIG. 2) where the upper feed roller 19 is separated from the lower feed roller 18.

Figure 4:
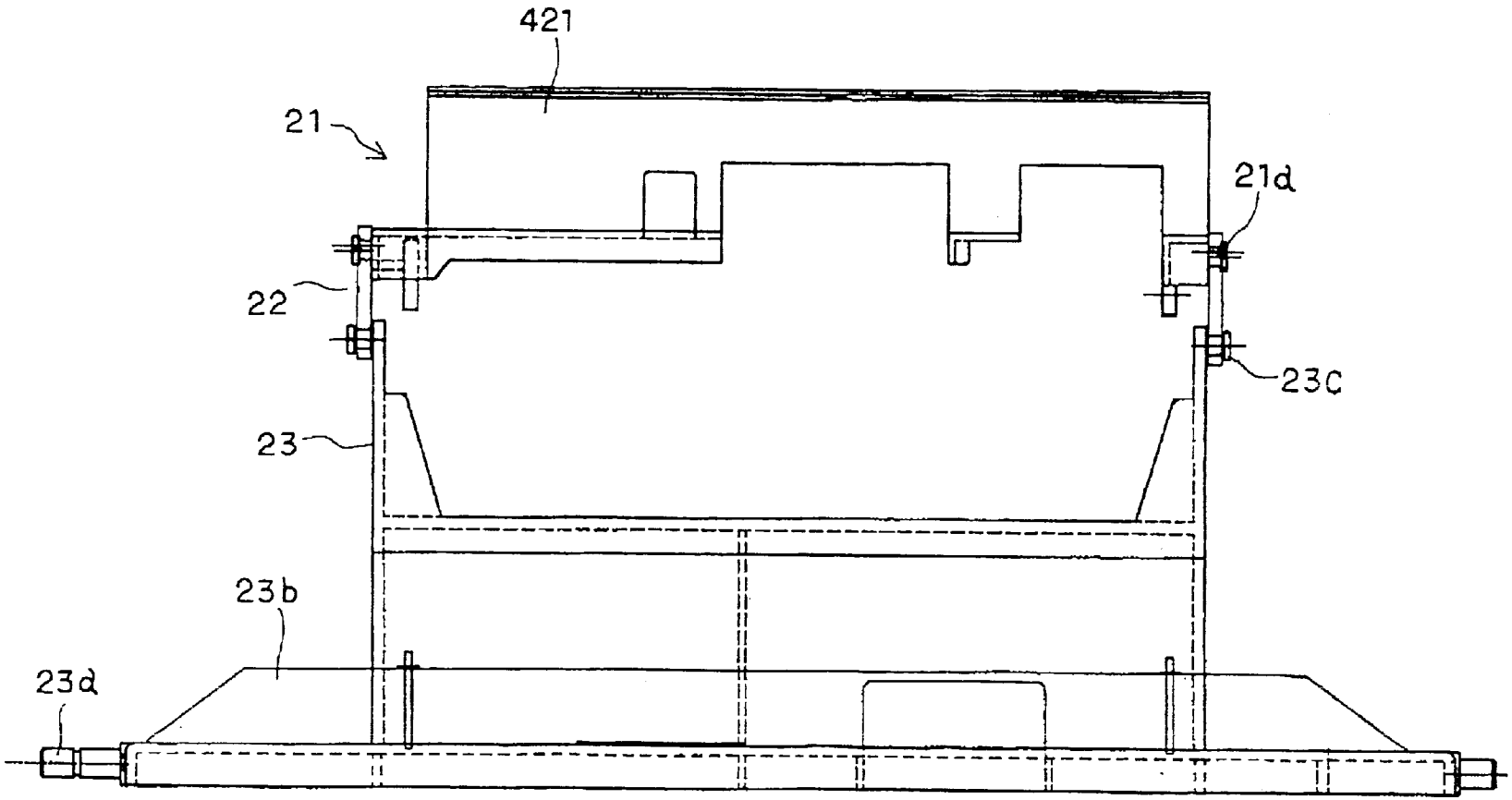
FIG. 4 is a front view for a stopper arrangement.
Figure 5:
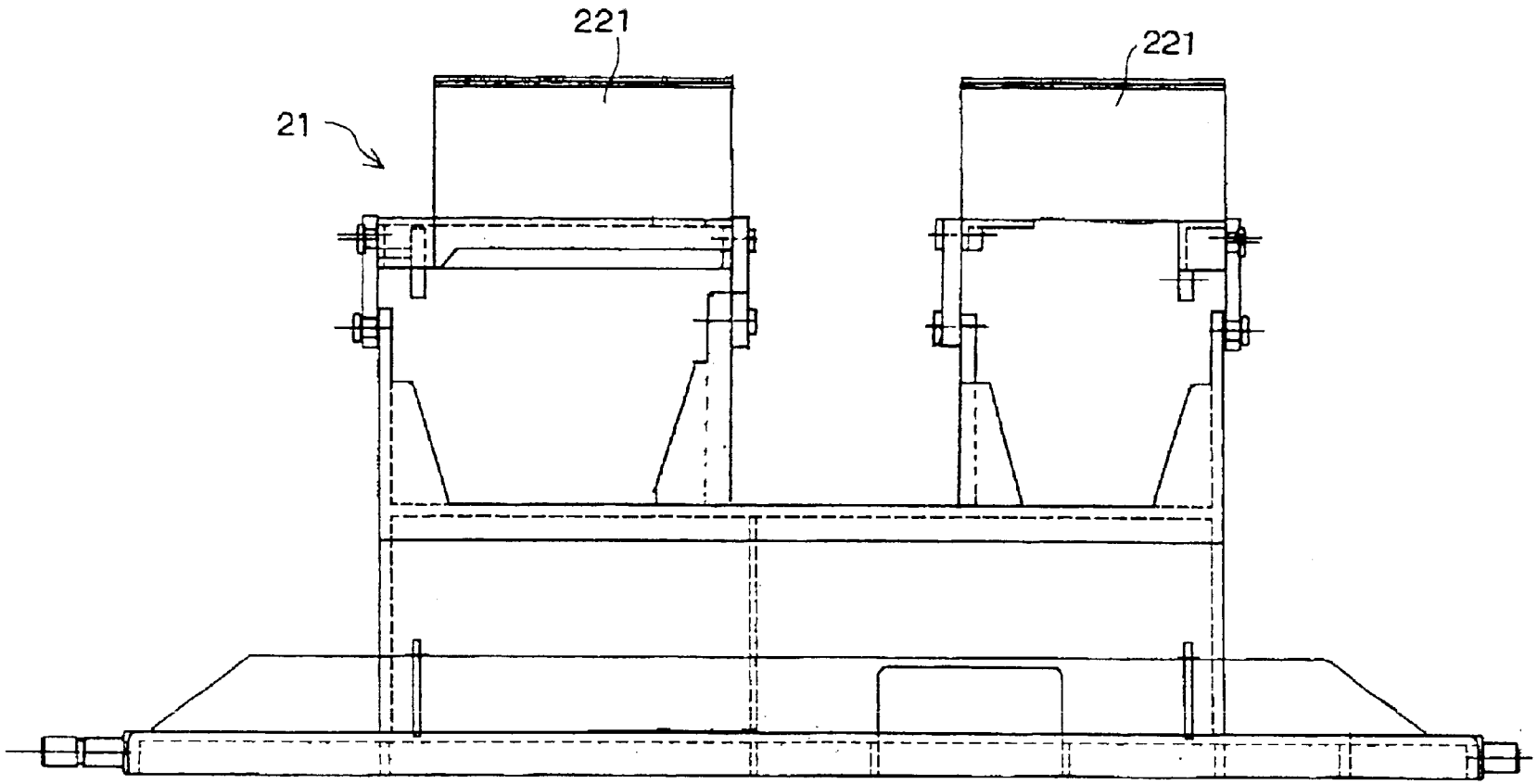
FIG. 5 is a front view for a plurality of stopper arrangements.

The stopper 21 has a single stopper plate 421 extending in the width direction of the sheet as shown in FIG. 4. The stopper plate 421 receives and limits the edge of the sheet moved by the rotation of the paddle 17, and discharged and dropped under its own weight into the processing tray 8 by the paired discharge rollers 6. The stopper 21 is rested at an end thereof by a first pulley shaft 10*a* and always protrudes toward a position that limits the edge of the sheet by a spring or the like (not shown). The stopper 21, made of a single plate, may be replaced by a plurality of stoppers 221 arranged in the width direction of the sheet as shown in FIG. 5.

The saddle stitching unit 30, as shown by linked double-dashed line in FIG. 2, forms a unit that allows the saddle stitching unit 30 to be drawn out of the sheet post-processing apparatus 2. The saddle stitching unit 30 has a staple driving head unit 31 having a staple cartridge (not shown) and an anvil unit 32 for bending the staple driven out of the staple driving head unit 31, the units 31 and 32 being formed below and above a sheet bundle feed path 25, respectively. The staple driving head unit 31 and the anvil unit 32 can be moved in the sheet bundle feed path 25 formed therebetween in a direction traversing the sheet bundle feed direction (from left to right in FIG. 2), the traversing direction being a direction along the front and back surfaces of the sheet bundle facing the staple driving head unit 31 and the anvil unit 32. Guide rods 33 and 34 are situated above and below the staple driving head unit 31 and the anvil unit 32, respectively, to guide the sheets in the direction traversing the sheet bundle feed direction of the staple driving head unit 31 and the anvil unit 32. Screw shafts 35 and 36 are shafts to shift the anvil unit 32 and the staple driving head unit 31. An anvil drive shaft 37 and a head drive shaft 38 are shafts that make the anvil unit 32 and the staple driving head unit 31 drive to bend the staples respectively.

Figure 6:
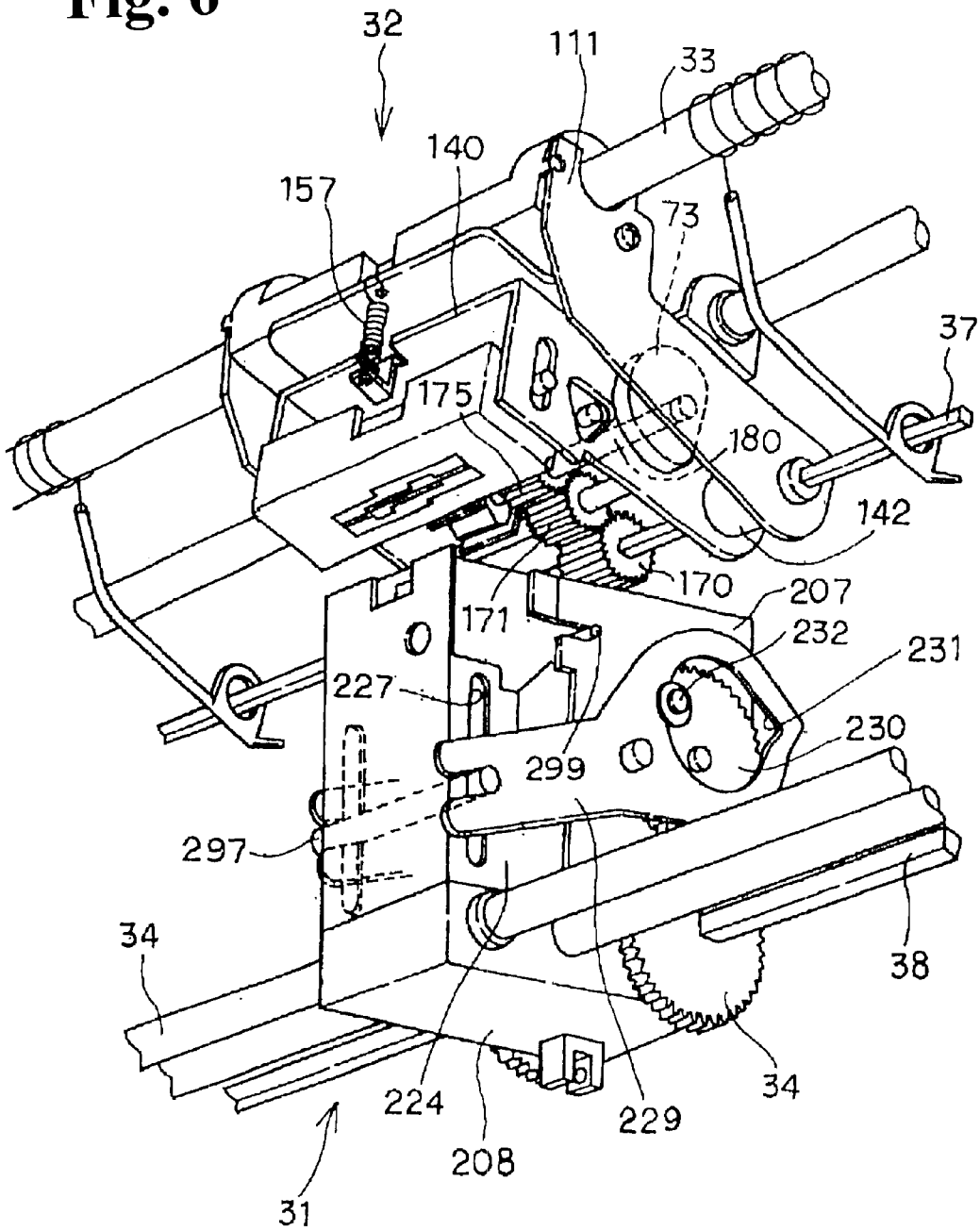
FIG. 6 is a perspective view for a stapler unit.

The head housing 224 is disposed below the staple driving head unit 31 together with the guide base block 208, as shown in FIG. 6. The head housing 224 is formed to be integrated into one body with the guide base block 208. The guide rod 34 passes through the guide hole opened on the guide base block 208 while abutting thereby guiding the swinging movement of the driving head unit 31.

An attachment block 207 is formed in the vicinity of the head housing 224, as shown in FIG. 6. The attachment block 207 includes a transmission gear 230 and an arm 220 for transmitting the drive force of the drive shaft 38 to a staple blade (not shown) inside the head housing 224. The pin 232 is disposed on the transmission gear 230 and moved along a cam face 231 of the arm 220. The recess in the leading edge of the arm 220 makes the pin 207 installed fixedly at the staple blade inside the head housing 224 move along a slit 227 inside the head housing 224, thereby providing the drive force to the staple blade.

Figure 7:
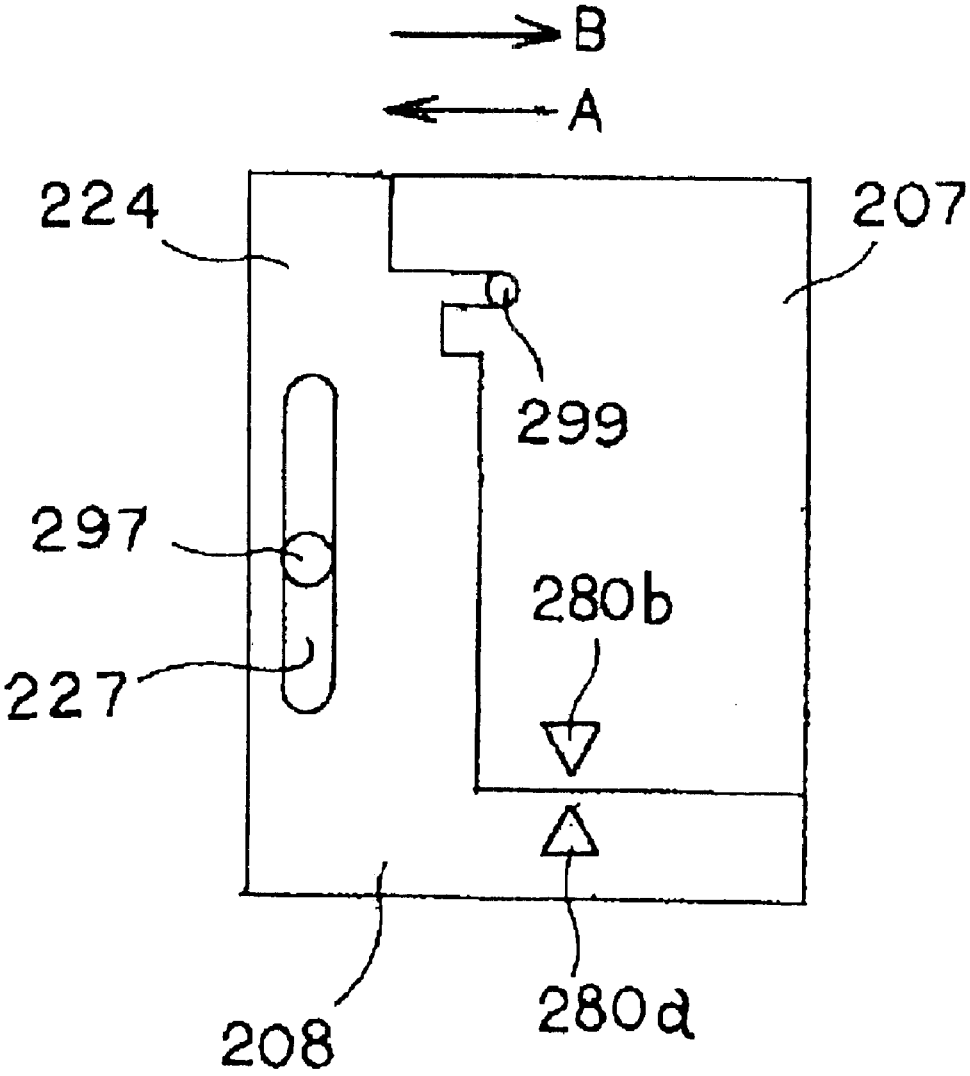
FIG. 7 is another view for a base section and an attachment section of the stapler.

FIG. 7 illustrates that the attachment block 207 is mountably attached to the guide base block 208 and the head housing 224 disposed to be integrated into one body in the directions of arrows A and B. The attachment block 207 is positioned by the positioning pin 200 on the head housing 224 engaged with a recess thereof and is fixed by a screw (not shown).

Furthermore, the guide base block 208 and the attachment block 207 are provided with positioning sensors 280*a* and 280*b*. The positioning sensors 280*a* and 280*b* detect whether or not the attachment block 207 is attached to the guide base block 208 and the head housing 224, and detect whether or not the attachment block 207 is attached to the correct position.

Such an arrangement allows only the attachment block 207 to be removed when a staple is jammed or in similar problems, thereby increasing maintenance efficiency. The arrangement also allows the head housing 224 including the staple driving staple blade (not shown) to remain in the apparatus together with the guide base block 208, so there is no deviation of the relative position to the staple blade and the anvil body 241, which requires high precision, even when mounting or dismounting for maintenance, thereby preventing later stitching errors.

Figure 8:
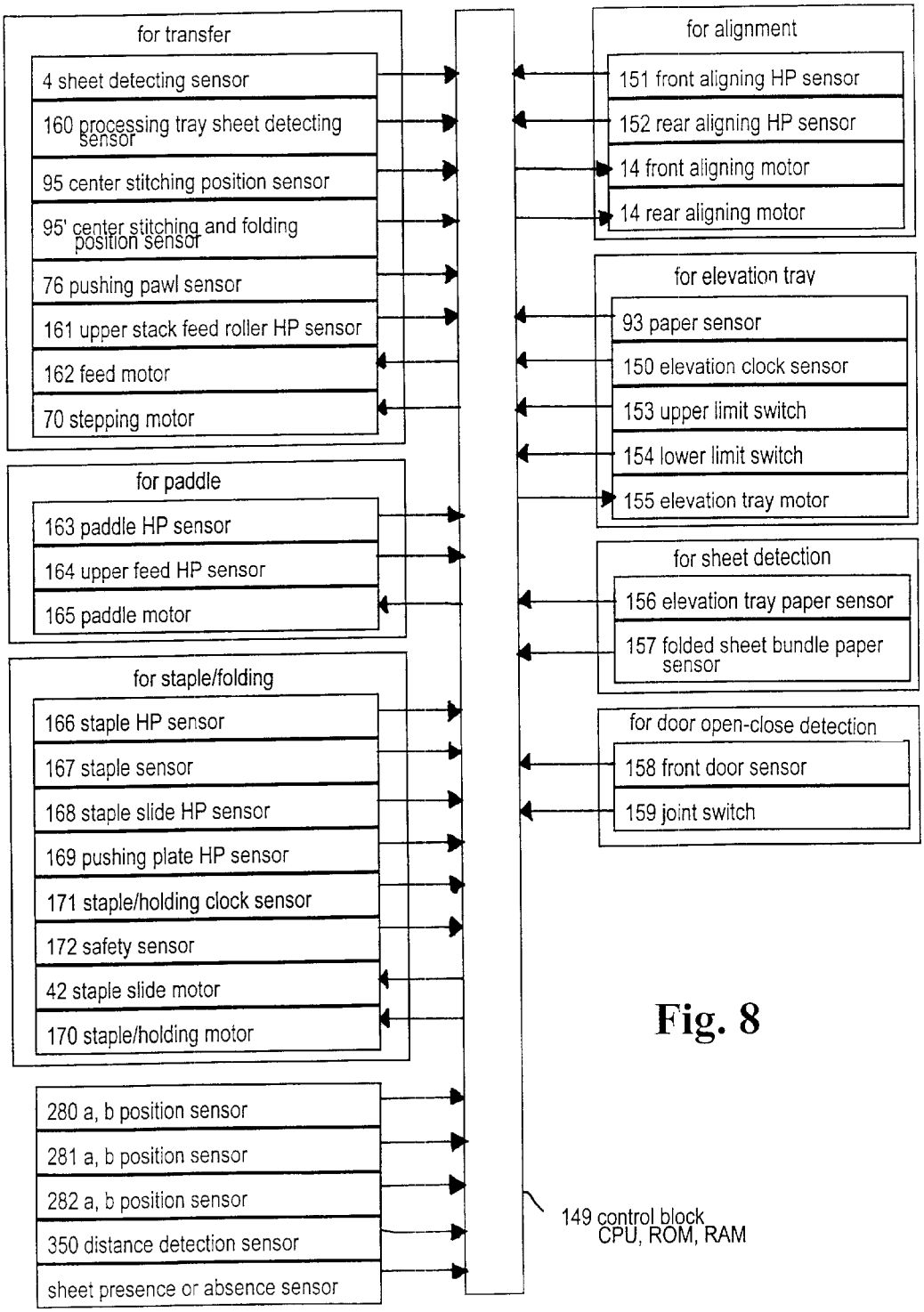
FIG. 8 is a block diagram for the sheet post-processing apparatus.

FIG. 8 shows a control block 149 which inhibits the driving head unit 31 and the anvil unit 32 from saddle stitching according to detection results of the positioning sensors 280*a* and 280*b* if the attachment block 207 is not attached or has been attached in a position that is incomplete. Such an operation can prevent staple stitching errors if a staple is clogged or actually not driven.

Figure 9:
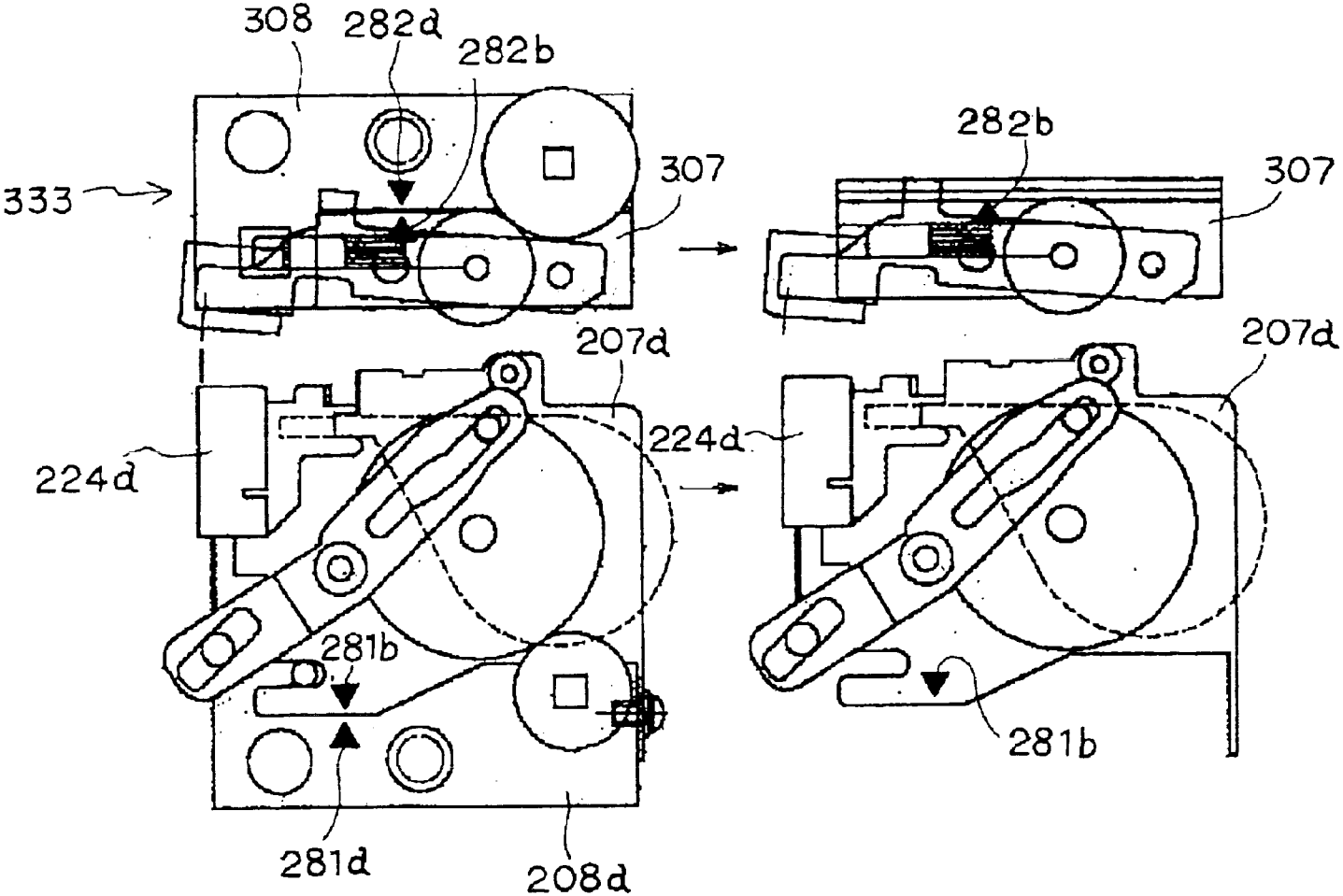
FIG. 9 is another view for a base section and an attachment section of the stapler.

In the embodiment described so far, as for the saddle stitching inhibit control according to the detection results of the positioning sensor when the attachment block is mounted and removed, it may be made possible by such a construction that a head 224*a* having the staple blade is integrated with attachment block 207*a* as shown in FIG. 9. For that construction, the detection results are obtained by a positioning sensor 281*a* formed on a guide base block 208*a* and a positioning sensor 281*b* formed on the attachment block 207*a*.

It is also possible to use an alternative structure for the anvil unit 333 to comprise the guide base block 308 mountably attached by an attachment block 307 thereby prohibiting the stitching process based on the detection results obtained by the positioning sensor 282*a* located on the guide base block 308 and the positioning sensor 282*b* located on the attachment block 307.

Furthermore, according to this embodiment, it is controlled to prohibit the saddle stitching based on the positioning detection detected by the control block 149 on the sheet post-processing apparatus when the attachment block is mounted and dismounted. However, it may also be made in an alternative way by using an additional control means formed in the saddle stitching unit 30 itself. Still a further alternative method would be made to have the control unit 921 in the main body 1.

Figure 10:
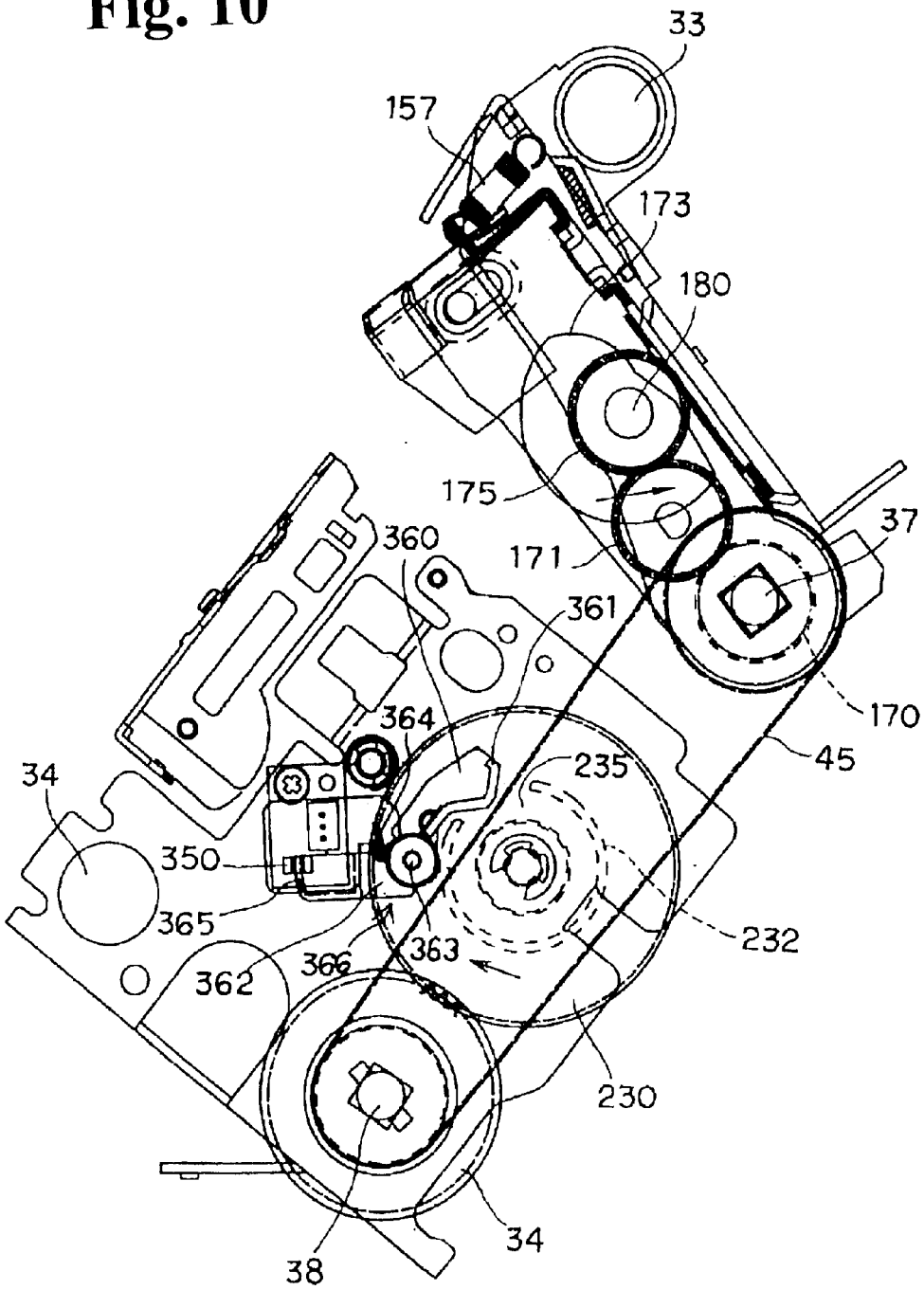
FIG. 10 is a view for space detecting means.
Figure 11:
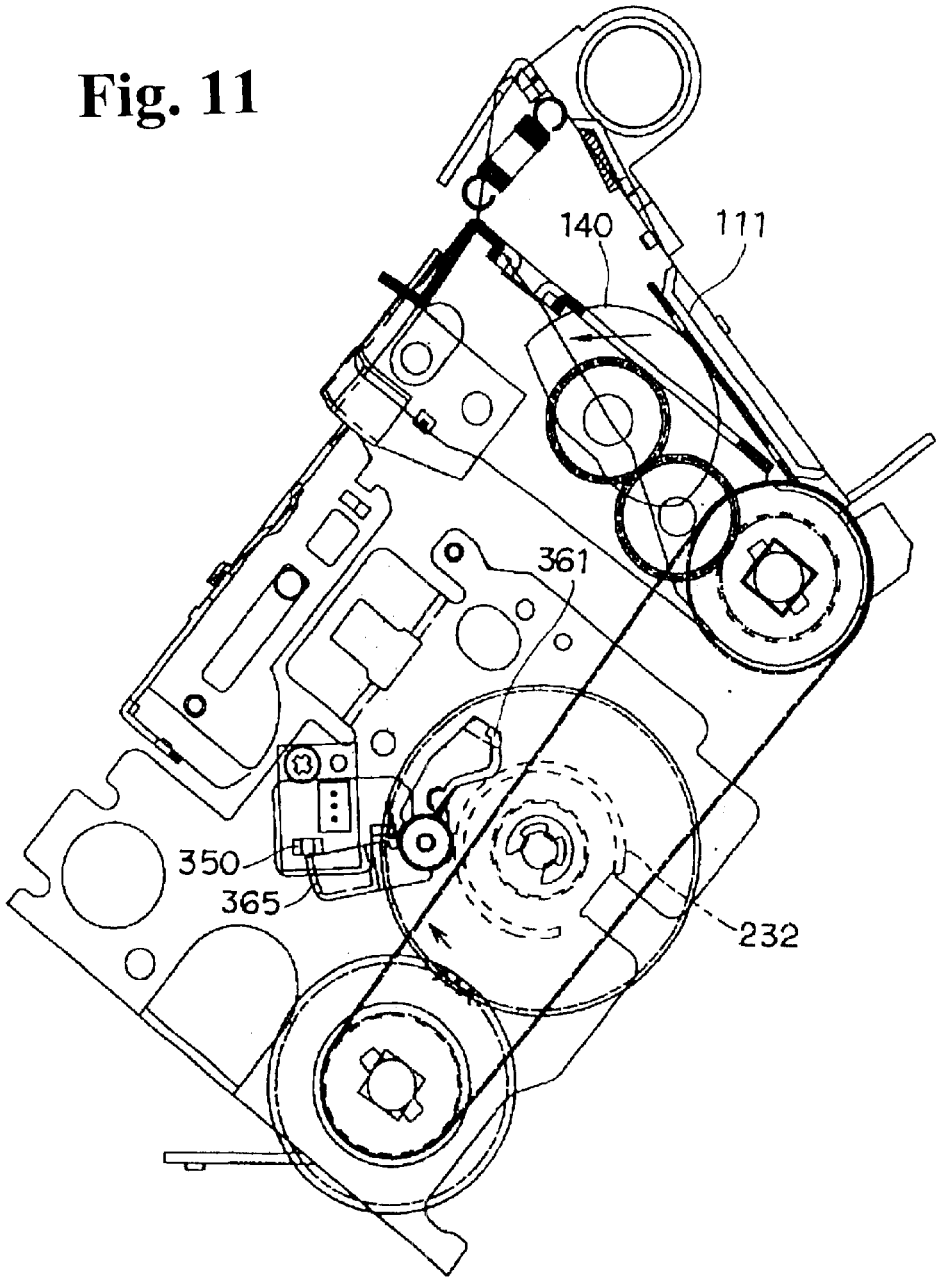
FIG. 11 is a view for space detecting means.

The saddle stitching unit of the present embodiment, as shown in FIGS. 10 and 11, has a gap detecting sensor 350 for detecting a gap between the staple driving head unit 31 and the anvil unit 32. In such a structure, the drive force of the drive shaft 38 is transmitted via a timing belt 45 and a staple/folding motor 170 located on the anvil drive shaft 37 in the anvil unit 32 to gears 171 and 175.

The cam 173 formed on the rotating shaft 180 on the gear 175 is engaged with a fixed frame 111 on the anvil unit 32.

A movable frame 140 on the anvil unit 32 supported via a collar 142 on the anvil drive shaft 37 to swing freely, as shown in FIG. 11, resists against the urging force of the coiled spring 157 to separate from the fixed frame 111 toward the driving head unit 31. Thus, the drive force of the head drive shaft 38 is transmitted to the gear 230 via the gear 34 formed on the head drive shaft 38 in synchronization with the drive force of the head drive shaft 38 that moves the movable frame 140 of the anvil unit 32 via the timing belt 45.

The circular cam 232 formed inside the gear 230 has a notch 235 thereon. A detection lever 366 comprising an engaging portion 360 and a detecting end 362 is rotatably situated around the shaft 363 and is constantly urged toward the cam 232 by the spring 364. If the gap between the driving head unit 31 and the movable frame 140 of the anvil unit 32 is fully opened, as shown in FIG. 10, an engaging portion 360 on the detecting lever 366 can enter the cut-out 235 on the circular cam 232 by the spring 364. This moves the detecting tip 365 on the detecting end 362 around the shaft 363 and is detected inside the gap detecting sensor 350. The gap detecting sensor 350 detects the detecting tip 365 to notice that the space between the driving head unit 31 and the movable frame 140 of the anvil unit 32 is fully opened, as shown in FIG. 10.

On the other hand, if the drive force of the head drive shaft 38 moves the movable frame 140 on the anvil unit 32 via the timing belt 45, as shown in FIG. 11, the gear 230 is rotated via the gear 34' disposed on the head drive shaft 38 to engage the circular cam 232 with the detecting lever 366. This resists the urging force of the spring 364 to press the engaging portion 360 on the detecting lever 366 from the cut-out 235 up to the engaging surface of the circular cam 232.

The engaging portion 360 has a slant surface formed at the tip 361 thereof so that the engaging portion 360 can be pressed to the engaging surface on the circular cam 232. Thus, the detecting tip 365 on the detecting end 362 is not detected by the gap detecting sensor 350 when moved outside the gap detecting sensor 350 with respect to the shaft 363 while the engaging portion 360 on the detecting lever 366 is pressed and engaged with the engaging surface on the circular cam 232.

That is, as the gap detecting sensor 350 does not detect the detecting tip 365, it is found that the space between the driving head unit 31 and the movable frame 140 on the anvil unit 32 are not in a full open state, as shown in FIG. 11, unlike FIG. 10. The gap detecting sensor 350 detects whether or not the space between the driving head unit 31 and the movable frame 140 on the anvil unit 32 is fully open, as in FIGS. 10 and 11. In addition, it is possible that the slit length of the gap detecting sensor 350 can be made longer to detect a range from the full open status to the desired narrower space.

The driving head unit 31 and the anvil unit 32 must be moved in the width direction of the sheet bundle if the saddle stitching is performed at a plurality of positions in the width direction of the sheet bundle, or if the driving head unit 31 and the anvil unit 32 are moved to a staple replacement position to replace the staples. For the saddle stitching unit 30 in the present embodiment, however, the control block 149 inhibits the driving head unit 31 and anvil unit 32 from moving toward the width direction of the sheet bundle in the condition that the gap detecting sensor 350 detects that the staple driving head unit 31 and the anvil unit 32 have a gap therebetween less than the predetermined range (other than the full open status as in FIG. 10). Such undesirable trouble happens often, for example, particularly if the sheet bundle is floating by the curling of the sheets, or if the sheet bundle is bulky due to too many sheets or is too thick as a sheet bundle. The trouble is caused by the sheet bundle positioned for saddle stitching at a loading portion between the driving head unit 31 and the anvil unit 32 coming into contact with the driving head unit 31 or the anvil unit 32. This deforms the posture of the sheet bundle aligned once by the aligning plates 9 resulting in the sheet bundle being stapled in the unaligned state.

Therefore, in this embodiment, the posture of the sheet stack is not deformed by any contact if the space is detected to exceed the predetermined distance. That is, in the status shown in FIG. 10, the control block 149 permits the driving head unit 31 and the anvil unit 32 to move in the width direction of the sheet stack. Therefore, the posture of the sheet stack is not deformed by any contact if it detects that the space exceeds a predetermined distance, that is, in the status shown in FIG. 10. The control block 149 then permits the driving head unit 31 and the anvil unit 32 to move in the width direction of the sheet stack.

However, as will be explained later, there could be a case that a sheet presence detection sensor (not shown) detects that the sheet stack is not present in the gap between the driving head unit 31 and the anvil unit 32. The case occurs, as an example, if the sheet stack does not reach the gap between the driving head unit 31 and the anvil unit 32 in the state that the pre-guide 370 for guiding the sheet stack to a feed guide 39 is moved to a predetermined position and idles. In that case, movements of the driving head unit 31 and the anvil unit 32 in the width direction of the sheet stack do not deform the posture of the sheet stack. The control block 149, therefore, permits the driving head unit 31 and the anvil unit 32 to move in the width direction of the sheet stack even if the gap detecting sensor 350 detects that the driving head unit 31 and the anvil unit 32 have a gap narrower than a predetermined value. This allows the driving head unit 31 and the anvil unit 32 to return to the home staple position that will be explained later.

This embodiment makes the above-described movement inhibit control in the width direction of the sheet bundle by way of detecting the gap between the driving head unit 31 and the anvil unit 32 on the saddle stitching unit 30. However, this method of control can be applied to all types of the mechanisms that move a stapler along the edge of a sheet bundle and bind the sheet bundle with a plurality of bindings other than a saddle stitch mechanism that mechanically links the head and the anvil. If a gap between the head and the anvil is detected to be too narrow, the stapler may be inhibited from moving along the edge of the sheet bundle.

The embodiment described above is for inhibiting the stapler movement when the gap is narrow, based upon the gap detection between the head and the anvil in the type of apparatus in which the stapler moves. However, in the type of a mechanism with a stapler in which the sheet bundle moves to the gap between the head and anvil, other than the saddle stitching unit or the saddle stitching that mechanically links the head and anvil, the sheet bundle may be inhibited from moving if the gap is detected to be too narrow according to the gap detection of the head and the anvil.

In other words, the relative movement of the sheet bundle to the stapler may be inhibited if the gap is detected to be too narrow according to the gap detection between the head and the anvil.

In place of the control block 149 on the sheet post-processing apparatus 2, alternatively, control means may be formed in the saddle stitching unit 30 itself so that the control means can inhibit the driving head unit 31 and the anvil unit 32 from moving in the width direction of the sheet bundle according to the gap detection between the driving head unit 31 and the anvil unit 32. Still another alternative is that the control unit 921 of the main body 1 may be used to make the control for the image forming system.

The embodiment explained above has the anvil unit 32 moved toward the driving head unit 31 thereby changing the gap. Alternatively, the driving head unit 31 may be moved toward the anvil unit 32. Still, a further alternative could be that both units may be moved toward each other.

It is also possible to form a plurality of gap detection sensors in a structure to automatically set to a predetermined gap using control means that automatically selects the gap detection sensor according to conditions, such as the number of sheets, the thickness of the paper of the sheet itself or the humidity or other conditions.

The fixed feed guide 39 is designed to guide the sheet bundle fed inside the saddle stitching unit 30.

The folding unit 50 for the sheet bundle is the unit indicated by chain double-dashed line in FIG. 2, and can be drawn out of the sheet post-processing apparatus 2 as in the saddle stitching unit 30. A stack feed guide 53 guides the sheet bundle nipped and fed between the upper feed roller 19 and the lower feed roller 18 located at the inlet of the saddle stitching unit 30. The upper stack feed roller 51 is located at the inlet of the folding unit 50. The lower feed roller 52 is located to face the upper bundle feed roller 51.

The upper bundle feed roller 51 moves between a position indicated by solid lines in FIG. 2 that presses the lower bundle feed roller 52 and a retract position indicated by dashed lines in FIG. 2. The upper bundle feed roller 51 is separated at the position indicated by the dashed lines in FIG. 2 from the lower feed roller 52 until the leading edge of the sheet bundle passes over the upper bundle feed roller 51 and the lower feed roller 52 by the upper feed roller 19 and the lower feed roller 18 placed at the inlet on the saddle stitching unit 30, and moves to a position indicated by the line in FIG. 2 to touch the lower feed roller 52.

A stack detecting sensor 54 for detecting the leading edge of the sheet bundle presses the upper stack feed roller 51 against the lower feed roller 52 when detecting the leading edge of the sheet bundle. The stack detecting sensor 54 is also used to set and control the folding position in the feed direction of the sheet bundle. An abutting plate 55 comprises a stainless steel plate, the leading end thereof being approximately 0.25 mm thick. The paired folding rollers or sheet folding rotors 57*a* and 57*b* are cylindrical rollers having flat parts extending in a direction traversing the direction of the sheet bundle fed. Both the rollers are urged in the directions to press each other when rotated.

The abutting plate 55 is positioned right above the paired folding rollers 57*a* and 57*b,* and a leading edge thereof can be moved close to the nips of the paired folding rollers 57*a* and 57*b*. Around the upper portion of the paired folding rollers 57*a* and 57*b,* there are formed ark-like backup guides 59*a* and 59*b* to guide and feed the sheet bundle together with the stack feed guide 53.

The backup guides 59*a* and 59*b* are interconnected to move with the abutting plate 55 moving up and down to make an opening around the sheet bundle for the paired folding rollers 57*a* and 57*b* when the leading edge of the abutting plate 55 moves close to the nips of the paired folding rollers 57*a* and 57*b*. The guide 56 for the sheet bundle guides downward the sheet bundle being nipped and fed by the upper stack feed roller 51 and the lower feed roller 52 until the leading edge, i.e. downstream edge, of the sheet bundle sags downward at a sheet bundle path 58. In the paired bundle discharge rollers 60*a* and 60*b,* the roller 60*a* is the drive roller, and the roller 60*b* is a driven roller.

A sheet bundle stacking tray 80 for the folded sheet bundles can stack the sheet bundles that have been folded by the paired folding rollers 57*a* and 57*b* and discharged by the paired bundle discharge rollers 60*a* and 60*b*. The folded sheet holder 81 keeps the sheet bundle discharged inside the sheet bundle stacking tray 80 using a spring or its own weight.

Figure 12:
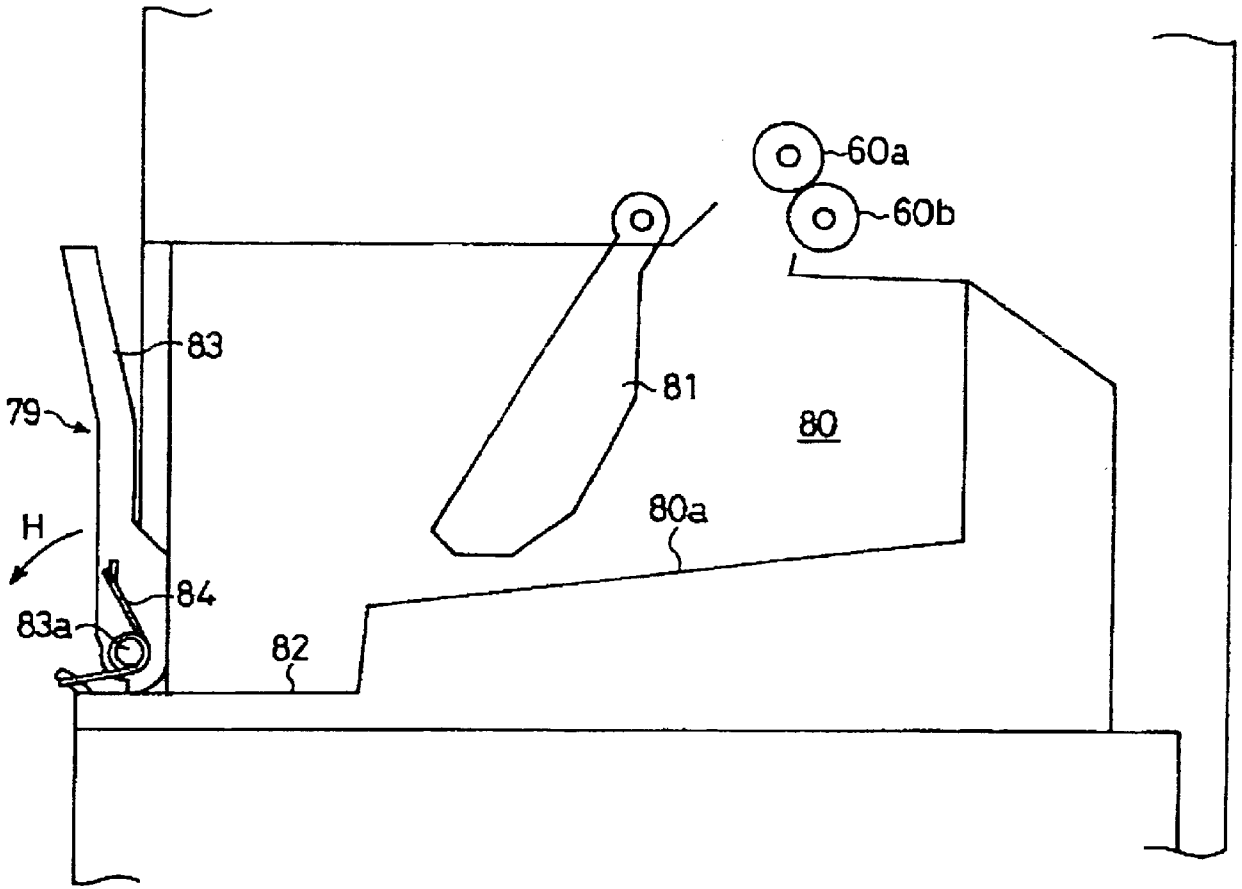
FIG. 12 is a front view for the folded sheet stacking device.
Figure 13:
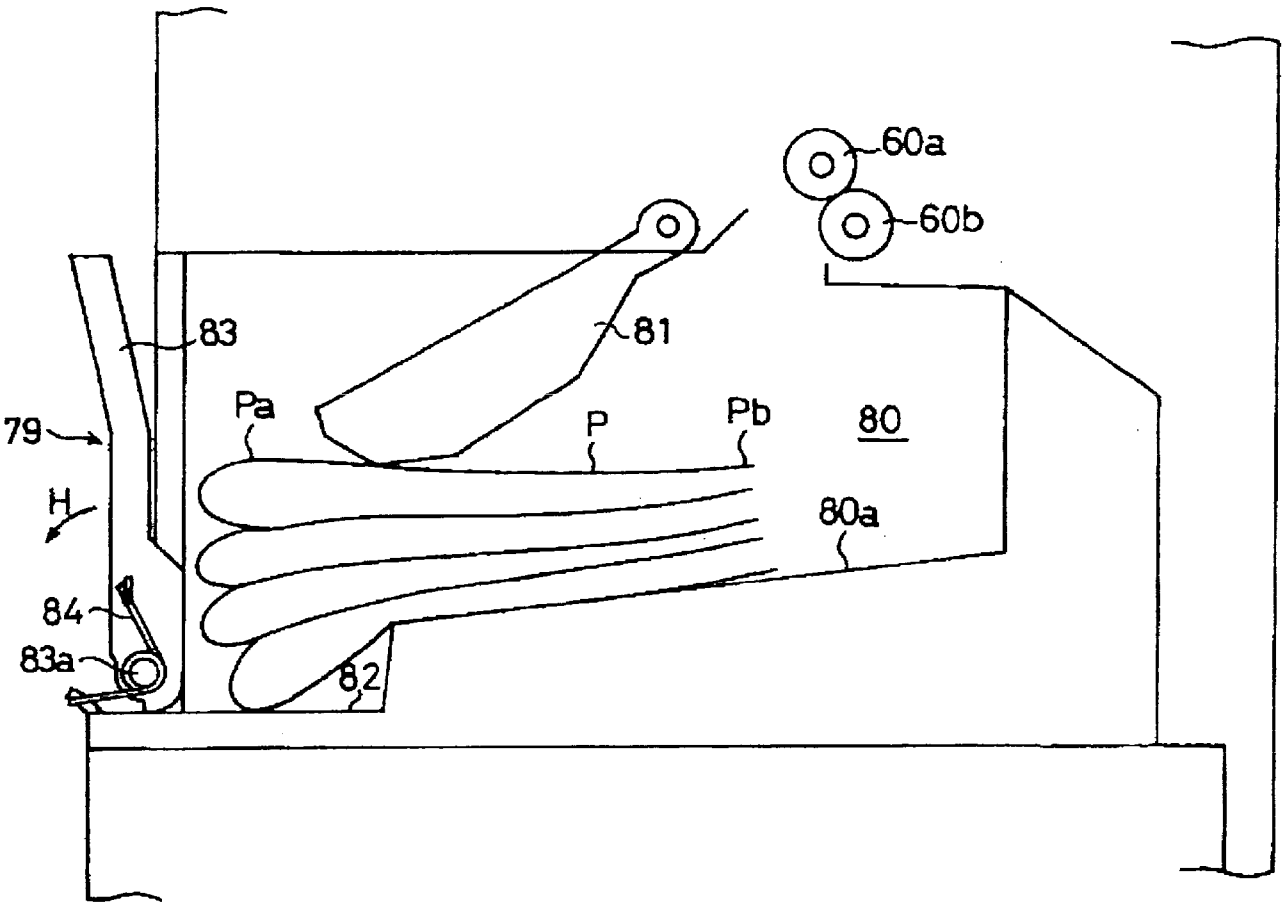
FIG. 13 is a view for a loading state of the sheet stacks when the folded sheet stacking device in FIG. 12 has a small amount of folded sheet stacks loaded thereon.
Figure 14:
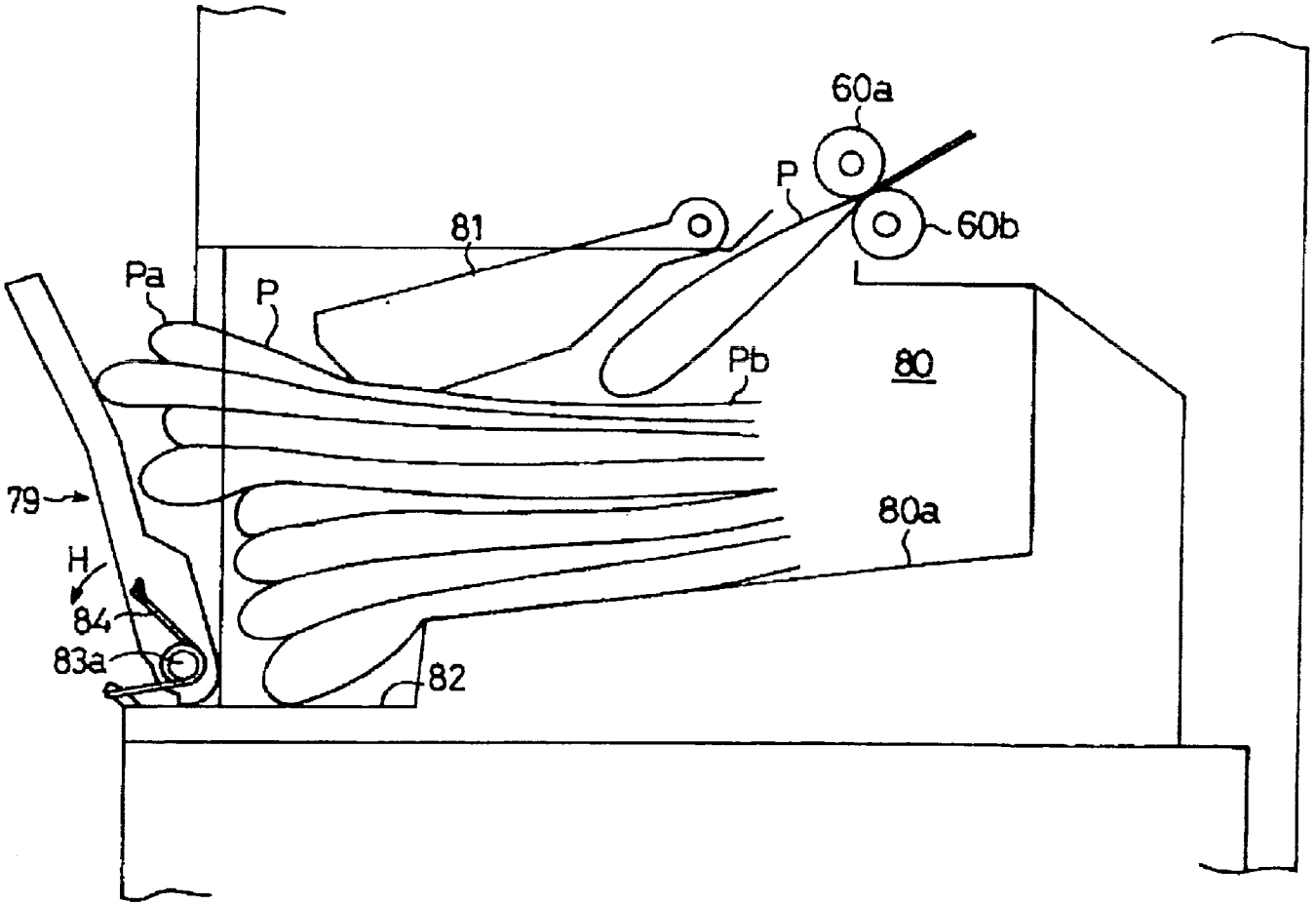
FIG. 14 is a view for a loading state of the sheet stacks when the folded sheet stacking device in FIG. 12 has a large amount of folded sheet stacks loaded thereon.

FIGS. 12 through 14 depict the folded sheet stacking device 79. The folded sheet stacking device 79 has a recess 82 for absorbing the expansion of the folded side of the sheet bundle formed on the bottom 80*a* of the sheet bundle stacking tray 80, i.e. discharge tray, and a stack stopper, i.e. stopper member, 83 that can be tilted in the direction of an arrow H urged virtually upright by a spring 84 with a rotating shaft 83*a* formed in the vicinity of the outlet for the sheet bundle stacking tray 80 as a fulcrum.

A sheet bundle path 58 is formed as a space to allow the sheet bundle to move between the sheet post-processing apparatus 2 frame and the sheet bundle stacking tray 80.

An elevator tray 90 moves up and down along the frame of the sheet post-processing apparatus 2. The elevator tray 90 can be elevated such that an elevator tray support 92 is engaged with a part of a belt rotated by drive means, such as elevator tray motor 155 (FIG. 8). A paper sensor 93 detects the uppermost surface of the sheet bundle on the elevator tray 90. A trailing edge guide 94 guides the trailing edge of the sheet on the elevator tray 91 which moves vertically. The elevator tray 91 is drawably formed into and out of the elevator tray 90, and is drawn out for stacking sheets of a large size.

The following describes the construction of the processing tray 8, the saddle stitching unit 30, and the folding unit 50 of the sheet post-processing apparatus 2 in detail in reference to FIG. 3 and later drawings.

FIG. 3 is a plan view for the processing tray 8. A first pulley 10 and a second pulley 11 have a feed belt 12 stretched tightly therebetween, and are positioned at substantially the center of the sheet in the width direction. On a first pulley shaft 10*a,* lower feed rollers 18 are located in two locations on each side of the sheet and substantially at the center of the sheet in the width direction thereof. The lower feed rollers 18 are hollow and tire-shaped rollers.

On the first pulley shaft 10*a,* there are formed two first pulleys 10 for rotating the feed belt 12 as mentioned above. The first pulleys 10 are driven to rotate counterclockwise by the rotation of the first pulley shaft 10*a* in FIG. 2 using a one-way clutch 75 interposed between the first pulleys 10 and the first pulley shaft 10*a*. The drive is cut and stops when rotating to the clockwise direction. The first pulley shaft 10*a* is interconnected via a pulley 73 fixed to the first pulley shaft 10*a,* a timing belt 74, and gear pulleys 72 and 71 to a motor shaft 70*a* on a stepping motor 70 which serves as a source for the feed drive.

Therefore, the lower feed roller 18 fixed to the first pulley shaft 10*a* is driven to rotate when the stepping motor 70 rotates to move the sheet on the processing tray 8 toward the staples in FIG. 2 (in the direction of an arrow B in FIGS. 2 and 3). The feed belt 12, however, is stopped because no drive force is transmitted thereto because of the one-way clutch 75. If the stepping motor 70 rotates to move toward a sheet elevator tray 90, the lower feed roller 18 and the feed belt 12 rotate toward the elevator tray 90 (in the direction of an arrow A in FIGS. 2 and 3).

Figure 15:
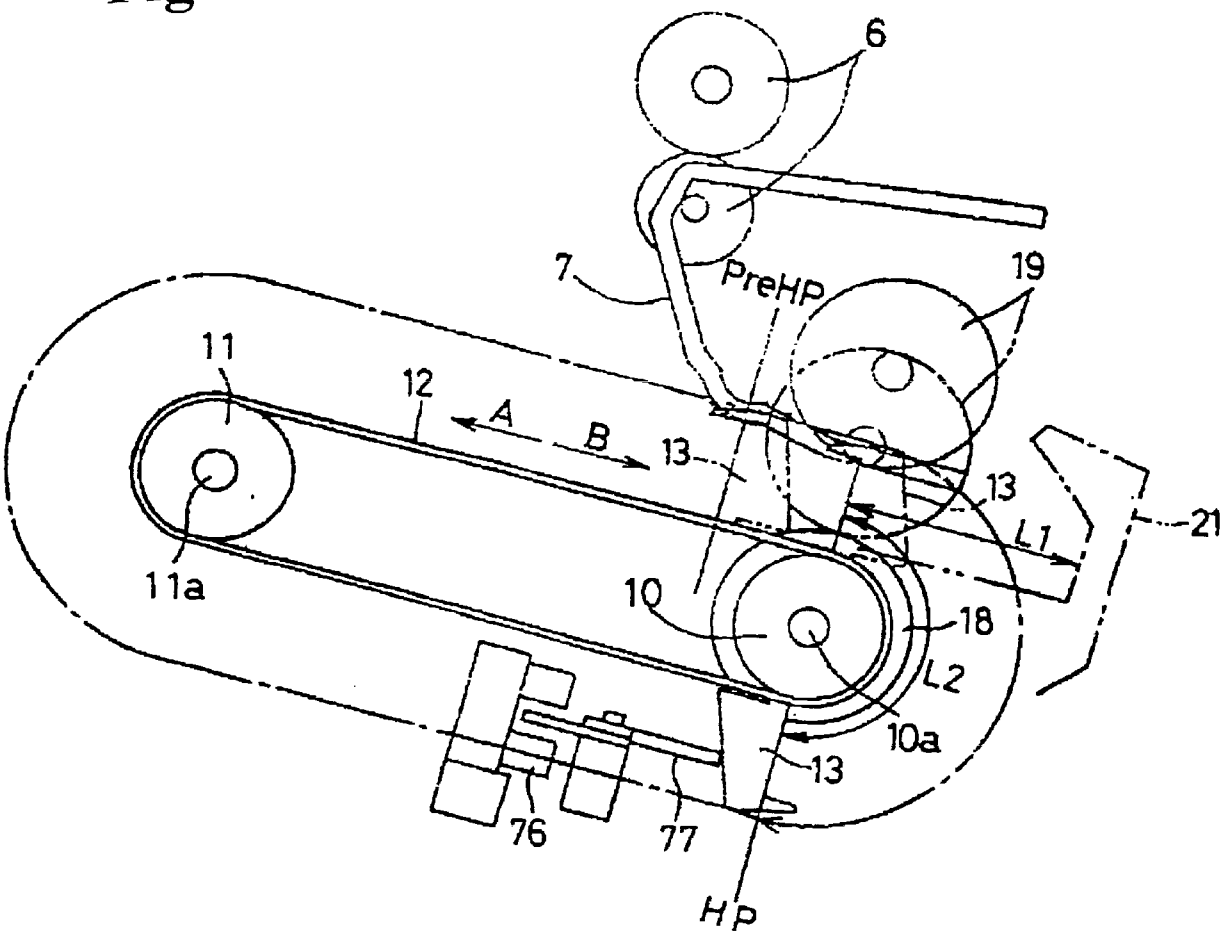
FIG. 15 is an enlarged view for a transfer belt portion of the sheet post-processing apparatus.

The following describes the feed belt 12 in reference to FIG. 15. The feed belt 12 stretched between the first pulley 10 having the one-way clutch 75 interposed at the first pulley shaft 10*a* and the second pulley 11, has a pushing pawl 13 formed thereon. A pushing pawl sensor 76 engaged with the pushing pawl 13 and a pushing pawl detecting arm 77 are formed at the bottom of the processing tray 8 to detect the home position, i.e. position HP in FIG. 15, for the pushing pawl 13. The home position (HP) is determined at the position where the pushing pawl sensor 76 is turned from OFF to ON by the pushing pawl detecting arm 77 pressed by the pushing pawl 13 moved by the feed belt 12. The positional relationship is illustrated in FIG. 15. Let P denote a nip for the lower feed roller 18 and the upper feed roller 19, L1 a length from the nip P to a stopper 21, and L2 a length from the nip P to the pushing pawl 13 along the feed belt 12. L1 and L2 are set as L1<L2.

The upper feed roller 19 is moved down by the action of a cam or the like (not shown) to press the lower feed roller 18. Afterward, if the stepping motor 70 rotates the first pulley shaft 10*a* counterclockwise (in the direction of an arrow A in FIGS. 2 and 3), then the lower feed roller 18 starts rotating to move the sheet bundle toward the elevator tray 90 (in the direction of the arrow A).

Note that also the upper feed roller 19 is rotated by the stepping motor 70 (see FIG. 3). Therefore, the sheet bundle is moved in the direction of the arrow A from the position of the stopper 21 inside the saddle stitching unit 30, by the rotation of the lower feed roller 18 and the upper feed roller 19. When the sheet bundle passes the nip position P, the pushing pawl 13 hits with rotation of the feed belt 12. With the pushing pawl 13, the sheet bundle is fed to the elevator tray 90 while being pressed in the direction of the arrow A. Because of L1<L2 as mentioned above, the pushing pawl 13 presses the bottom of the sheet bundle upward from the right side in FIG. 15, thereby always pressing the edge of the sheet bundle vertically. This does not cause excess stress in the transferring of the sheet bundle.

When binding, the pushing pawl 13 moves counterclockwise from the position HP in FIG. 15 before receiving the sheet bundle moved from the stopper 21 by the paired rollers 18 and 10 synchronized therewith to feed the sheet bundle and push it out.

However, if the sheets fed into the processing tray 8 are not saddle-stitched by the saddle stitching unit 30, the sheet bundle is not required to be moved to the stopper 21 position. The stepping motor 70 is driven in advance to move the pushing pawl 13 from the HP position in FIG. 15 to a movement idle position (L2+α or Pre HP position in FIG. 15) away from the nipping position of the lower feed roller 18 and the upper feed roller 19 in a direction toward the elevator tray 90. The increased distance (L2+α) can be set by changing a step number count of the stepping motor 70. If the present sheet post-processing apparatus 2 does not need to saddle-stitch the sheets, the sheets do not need to be transferred to the stopper 21, but the pushing pawl 13 can be moved to the Pre HP position in advance to stack the sheets on the elevator tray 90 before pushing the sheet bundle out. This means that the sheet post-processing apparatus 2 can handle a high-speed copier.

Note that if the Pre HP position of the pushing pawl 13 is a position where the feed guide 7 and the top of the pushing pawl 13 overlap each other, as shown in FIG. 15, the sheets fed one by one can be securely stacked at the Pre HP position where the pushing pawl 13 exists. Such an arrangement allows the pushing pawl 13 to deliver the sheet bundle to the elevator tray 90 quickly.

The saddle stitching unit 30, as shown in FIGS. 16 through 19, has right and left unit frames 40 and 41, guide rods 33 and 34, screw shafts 35 and 36, drive shafts 37 and 38 formed between the frames 40 and 41, the anvil unit 32 thereabove and the driving head unit 31 therebelow. The screw shaft 36 is engaged with the driving head unit 31. The driving head unit 31 is moved in the horizontal direction in FIG. 16 by rotation of the screw shaft 36. The anvil unit 32 also is arranged similarly. The screw shaft 36 is connected with a stapler slide motor 42 via a gear outside the unit frame 41. Drive force of the stapler slide motor 42 is transmitted also to the anvil unit 32 by a timing belt 43. This allows the driving head unit 31 and the anvil unit 32 to move in a direction (horizontal direction in FIG. 16) traversing the sheet feed direction without deviation to vertical positions thereof.

The stapler slide motor 42, therefore, can be driven to control the driving head unit 31 and the anvil unit 32 to move to desired positions depending on the width of the sheet, thereby allowing the staple to be driven at a desired position.

Top guides 46*a*, 46*b*, 46*c* and 46*d*, which are float preventing guide members, are movably supported on the guide rod 33 and the anvil drive shaft 37 above the feed path 25 in an area surrounded by the anvil unit 32 and the right and left unit frames 40 and 41. Compression springs 47*a*, 47*b*, 47*c*, 47*d*, 47*e* and 47*f* made of an elastic material are interposed between the unit frame 41 and the upper guide 46*a*, between the upper guide 46*a* and the upper guide 46*b*, between the upper guide 46*b* and the anvil unit 32, between the anvil unit 32 and the upper guide 46*c*, between the upper guide 46*c* and the upper guide 46*d*, and between the upper guide 46*d* and the unit frame 41. The top guides 46*a*, 46*b*, 46*c* and 46*d* move the upper guide rod 33 and the anvil drive shaft 37 in coordination with the movement of the anvil unit 32.

Figure 16:
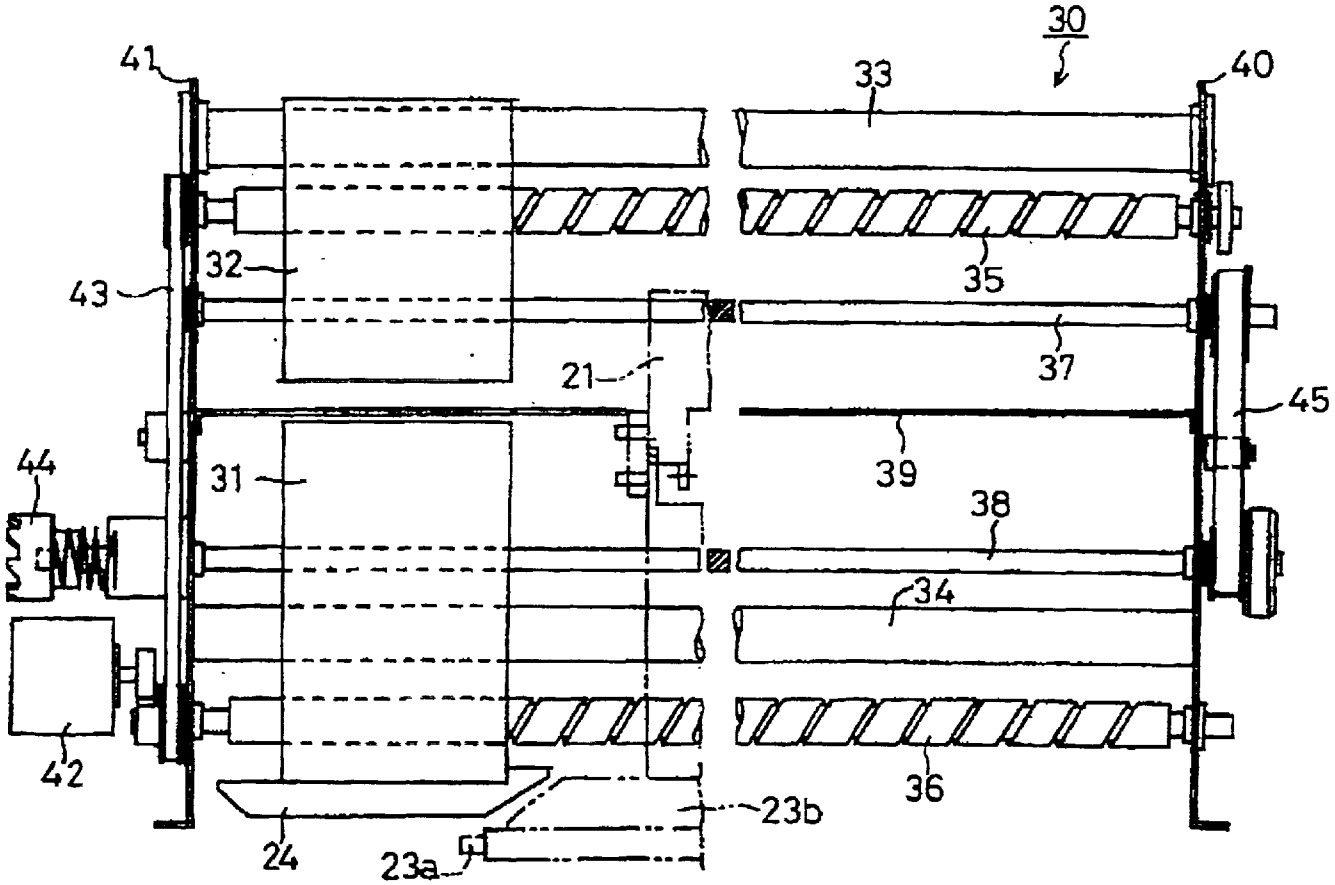
FIG. 16 is a view for a stapler unit of the sheet post-processing apparatus as viewed in a sheet feed direction.
Figure 17:
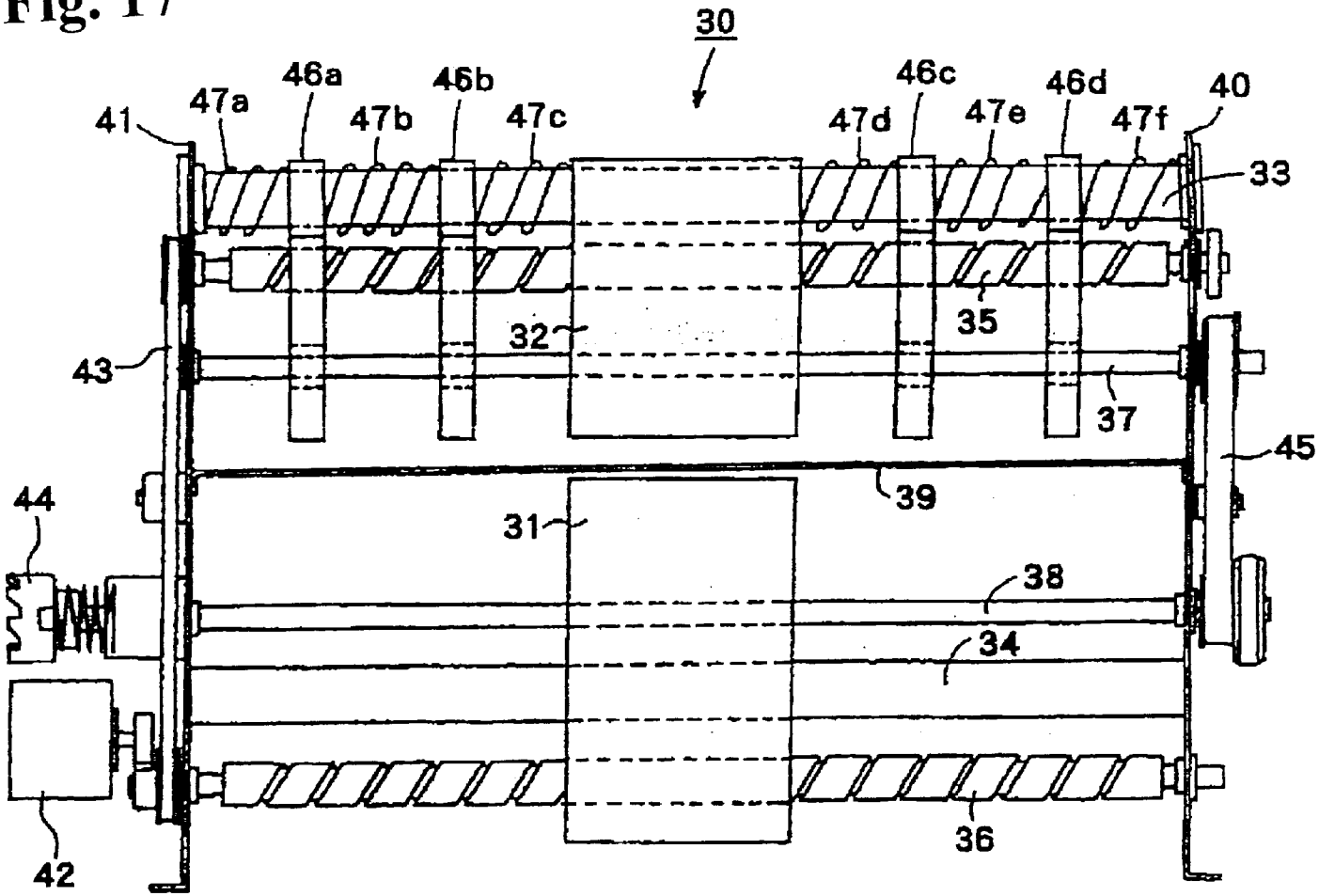
FIG. 17 is another view for the stapler unit of the sheet post-processing apparatus as viewed in the sheet feed direction.
Figure 18:
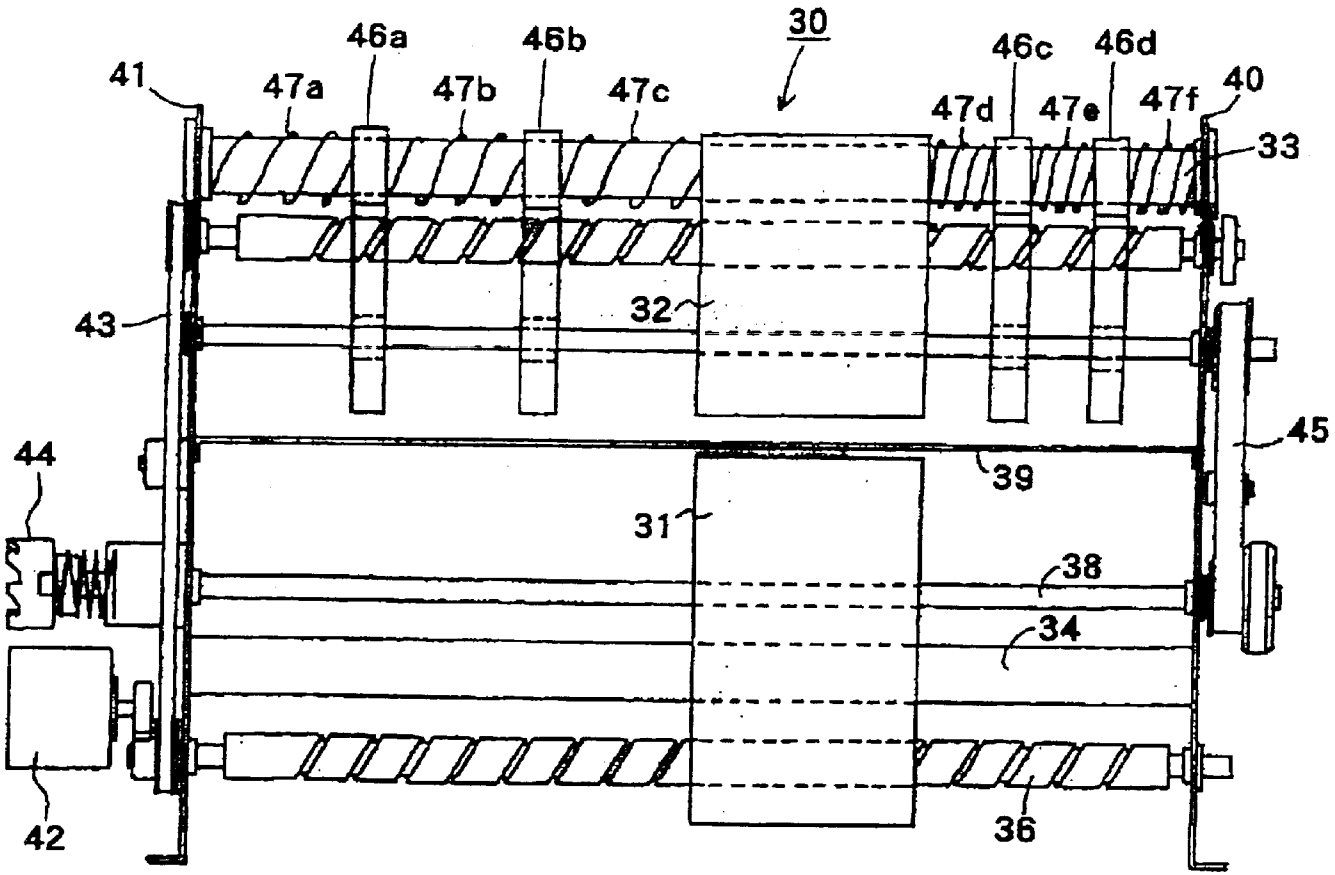
FIG. 18 is still another view of the stapler unit of the sheet post-processing apparatus as viewed in the sheet feed direction.

As an example, when the sheet stack is saddle-stitched on a right side in FIG. 15, as shown in FIG. 16, the driving head unit 31 and the anvil unit 32 move to the desired stitching positions on the right side while maintaining the relative positional relationship therebetween. Along with the movement, the compression springs 47*d*, 47*e* and 47*f* on the right side are compressed by the anvil unit 32 in coordination with the movement of the anvil unit 32. The top guides 46*c* and 46*d* are moved to the right side, pushed by the compression springs 47*d* and 47*e*.

The compression springs 47*a*, 47*b* and 47*c* located to the left side of the anvil unit 32 are extended in coordination with the movement of the anvil unit 32. The top guides 46*a* and 46*b* also move to the right side to guide at the desired position depending on the sheet stitching position.

The drive forces for moving the head to drive the staples in the driving head unit 31, to move the staples, and to bend the staples in the anvil unit 32 are provided through a coupling device 44 from the sheet post-processing apparatus 2, and are also transmitted to the anvil unit 32 through a timing belt 45 on the unit frame 40. A moving arm 23 (FIGS. 19 and 4) and the stopper are connected therewith by a connecting pin 23*c*, a connecting lever 22, and a connecting pin 21*a*. The stopper 21 is pivoted by the first pulley shaft 10*a*.

Figure 19:
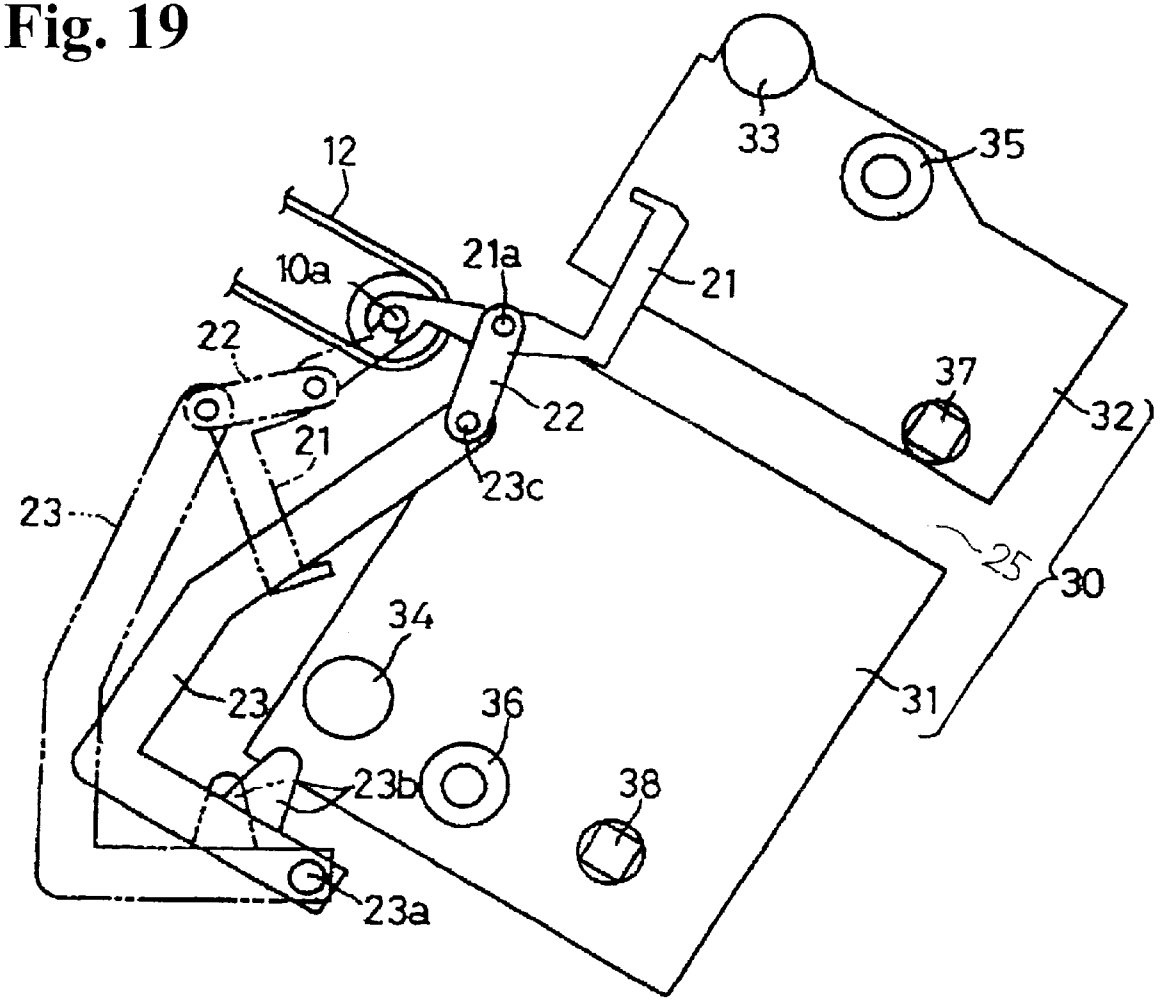
FIG. 19 is an operational view for a stopper of the sheet post-processing apparatus.

The following describes the appearance and disappearance of the stopper 21 in the staple path to set the staple driving positions on the edge of the sheet stack with the driving head unit 31 moved in the width direction of the sheets, in reference to FIGS. 16 and 19. Below the driving head unit 31 in FIG. 16, there is formed the stopper engaging projection 24 that can engage the stopper 21 with the moving arm 23. With the moving of the driving head unit 31, the stopper engaging projection 24 is engaged with a moving arm projection 23*b*. This causes the moving arm 23 to rotate counterclockwise on the turning shaft 23*a* to move to the position of the chained, double-dashed line in FIG. 19. The stopper 21, therefore, can not prevent the driving head unit 31 and the anvil unit 32 from moving in the width direction of the sheet bundle.

In the above-mentioned operational construction, the movement of the driving head unit 31 engages the stopper engaging projection 24 with the moving arm projection 23*b*, as shown in FIG. 5, but a plurality of stoppers 221 may be alternatively formed in position and all can be retracted from the staple path and the sheet bundle feed path 25.

Figure 20:
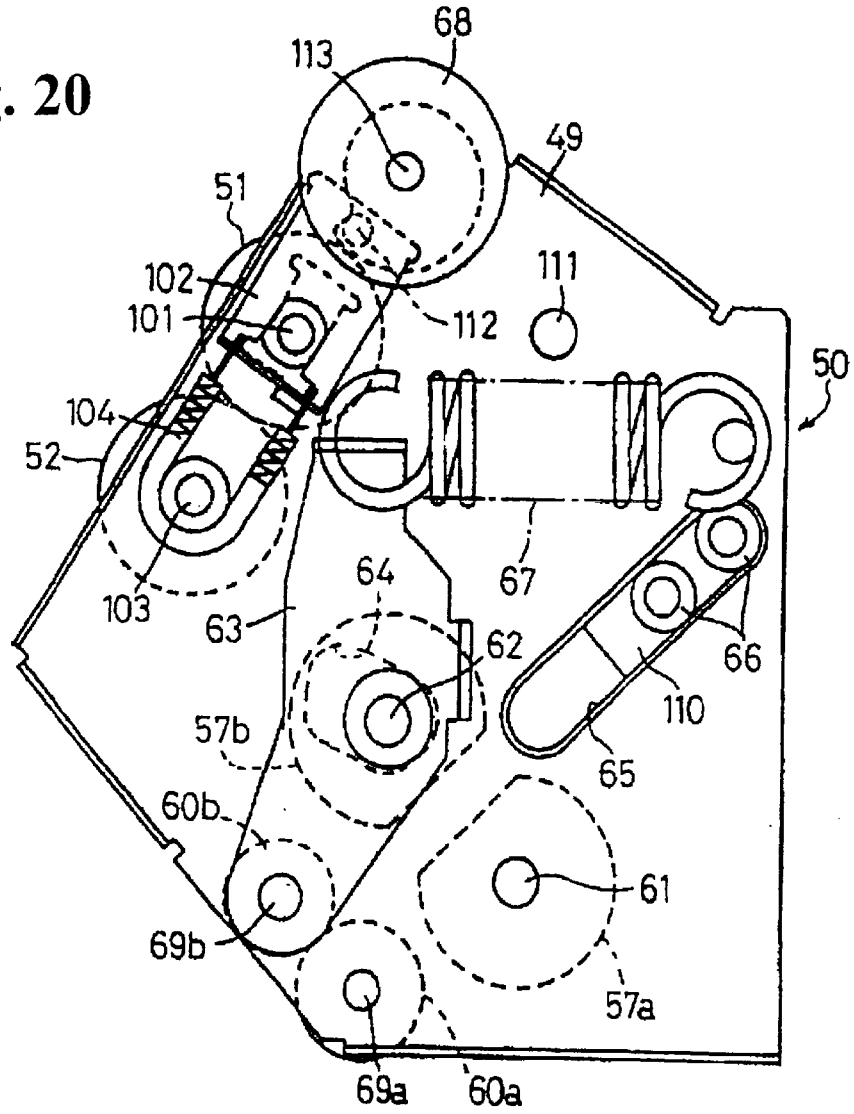
FIG. 20 is a front view for a frame for a folding unit of the sheet post-processing apparatus.

The following describes a folding unit 50 referring to FIGS. 20 through 25. FIG. 20 illustrates a unit frame 49 on the folding unit 50. A back frame in FIG. 20 is made in a shape similar to the folding unit 50 that is drawably disposed from the sheet post-processing apparatus 2. The unit frame 49 on the folding unit 50 has a folding roller drive shaft 61 formed as a rotating shaft for a folding roller 57*a* and a drive shaft 69*a* for a stack discharge roller 60*a*. A drive shaft 62 for a folding roller 57*b* is formed on a folding roller holder 63 turning around a drive shaft 60*b* on the stack discharge roller 60*b*. A tension spring 67 having a tensile force of approximately 5 kg is situated between the folding roller holder 63 and the unit frame 49. The unit frame 49 has a frame guide 64 formed thereon that is a hole for allowing the drive shaft 62 to move by the folding roller holder 63.

Therefore, when the paired folding rollers 57*a* and 57*b* fold and feed the sheet bundle, the tension spring 67 applies a fixed pressure to the sheet bundle thereby assuring that the sheet bundle is securely folded.

The folding unit frame 49 has an abutting plate frame guide 65 formed thereon that is a long hole to guide rollers 66 located on a support holder 110 to support the abutting plate 55. The abutting plate frame guide 65 allows the abutting plate 55 to move toward the paired folding rollers 57*a* and 57*b*. The unit frame 49 also has a fixed frame 111 thereon for rotatably pivoting a cam plate 114 to move the abutting plate 55.

The folding unit frame 49 further has an upper roller shaft 101 for the upper stack feed roller 51 and a lower roller shaft 103 for the lower feed roller 52 formed thereon to feed the sheet bundle into the folding unit 50. The folding unit frame 49 is further arranged to position the upper stack feed roller 51 away from the lower feed roller 52 until the sheet bundle is fed into the folding unit 50.

The upper roller shaft 101 on the paired the stack feed rollers 51 and 52 is supported in position by a bearing holder 102. The bearing holder 102 has a cam follower 112 formed at an end thereof. The cam follower 112 is engaged with the upper roller moving cam 68 disposed rotatably on the unit frame 49. A tension spring 104 having a tensile force of approximately 300 g is situated between the other end of the bearing holder 102 and the lower roller shaft 103. The tension spring 104 always presses the upper stack feed roller 51 to the lower feed roller 52. With the rotation of the upper roller moving cam 68, the bearing holder 102 resists or is pulled by the tension spring 104 to move up and down to thereby move the upper stack feed roller 51 between the position away from the lower feed roller 52 and the pressing position.

Figure 21B:
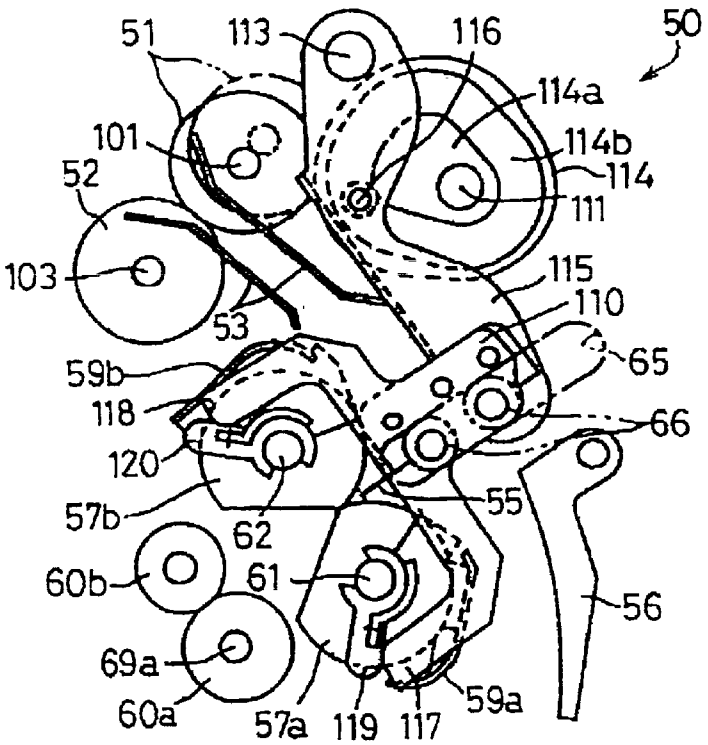
FIG. 21(*a*) is a view for the folding unit of the sheet post-processing apparatus before folding the sheet, and FIG. 21(*b*) is a view for the folding unit during folding of the sheet.
Figure 21A:
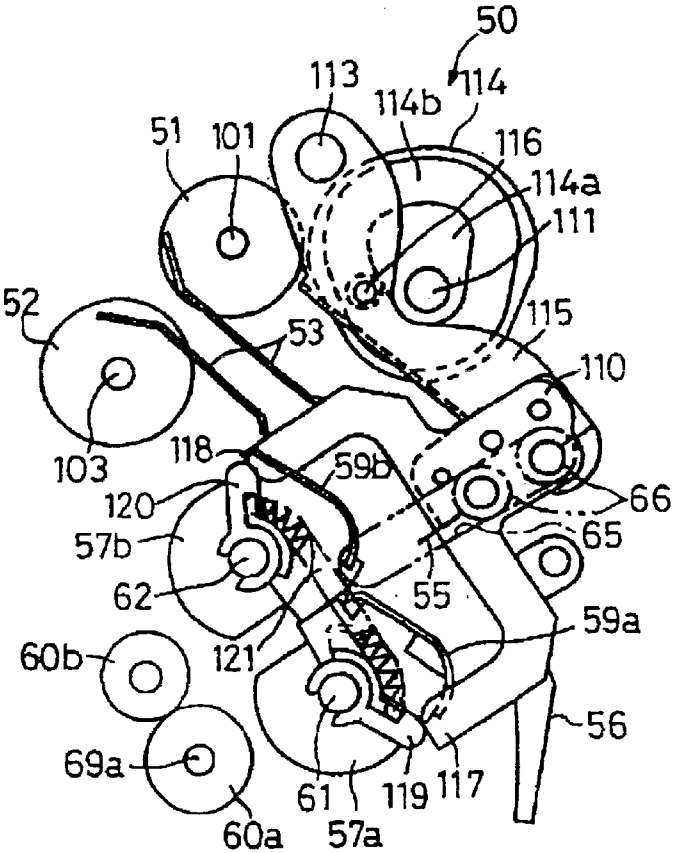

FIG. 21 illustrates an arrangement for the folding operation that is formed inside the unit frame 49 shown in FIG. 20.

A fixed frame 111 has a cam plate 114 fixed thereon. The fixed frame 111 is rotated to drive the cam plate 114 to rotate. The cam plate 114 has a cam follower 116 put in a cam plate 114, the cam follower 116 being made to stand virtually at a center of a turnable actuating arm 115 around the shaft 113. The actuating arm 115 has the abutting plate 55 formed at the leading end thereof via the support holder 110.

Therefore, the drive rotation of the cam plate 114 moves the actuating arm 115 up and down thereby moving the abutting plate 55 formed on the actuating arm 115 up and down. The abutting plate 55 for pressing the sheet bundle is made of stainless steel that is approximately 0.25 mm thick. Next, the support holder 110 that supports the abutting plate 55 is interconnected with the backup guides 59*a* and 59*b* to guide around the paired folding rollers 57*a* and 57*b*.

The backup guides 59*a* and 59*b* are arranged to cover the outside surfaces of the paired cylindrical folding rollers 57*a* and 57*b* extending in a direction traversing the direction of the sheet feed. The backup guides 59*a* and 59*b* turn around the outside surfaces of the paired folding rollers 57*a* and 57*b* around shafts 61 and 62 on the paired folding rollers 57*a* and 57*b*, respectively.

Lever tips 110 and 120 are formed at the outside ends of the backup guides 59*a* and 59*b*. The backup guides 59*a* and 59*b* are pulled toward each other by a spring 121. The lever tips 110 and 120 abut against actuating tips 117 and 118 that are forked for the support holder 110 to support. Therefore, when the backup guides 59*a* and 59*b* are in a state as shown in FIG. 21(*a*), they cover the outside surfaces of the feed path of the paired folding rollers 57*a* and 57*b*, thereby enabling the sheet bundle to touch the rubber surfaces of the paired folding rollers 57*a* and 57*b* tightly enough to guide the sheet bundle. The backup guides 59*a* and 59*b* also serve to guide, back up, or support, the sheet bundle. It should be noted that the backup guides 59*a* and 59*b* also function usually as the lower feed guides for the sheet bundle together with the stack feed guide.

In folding the sheet bundle, as shown in FIG. 21(*b*), the lever tips 110 and 120 are pressed depending on a downward movement of the actuating tips 117 and 118 on the support holder 110. As a result, the backup guides 59*a* and 59*b* resist the spring 121 to turn around the shafts 61 and 62, thereby making the outside surfaces of the paired folding rollers 57*a* and 57*b* securely abut the sheet bundle.

The following describes the drive force transmission system of the folding unit 50. The drive force transmission system is divided into two, i.e. a rotating and separating system formed of the upper stack feed roller 51 and the lower feed roller 52 shown in FIGS. 22 and 23, and a movement transmission system formed of the paired folding rollers 57*a* and 57*b* and the abutting plate 55 shown in FIG. 24. Those transmission systems are all disposed on the back frame of the unit frame 49 shown in FIG. 20.

Figure 22:
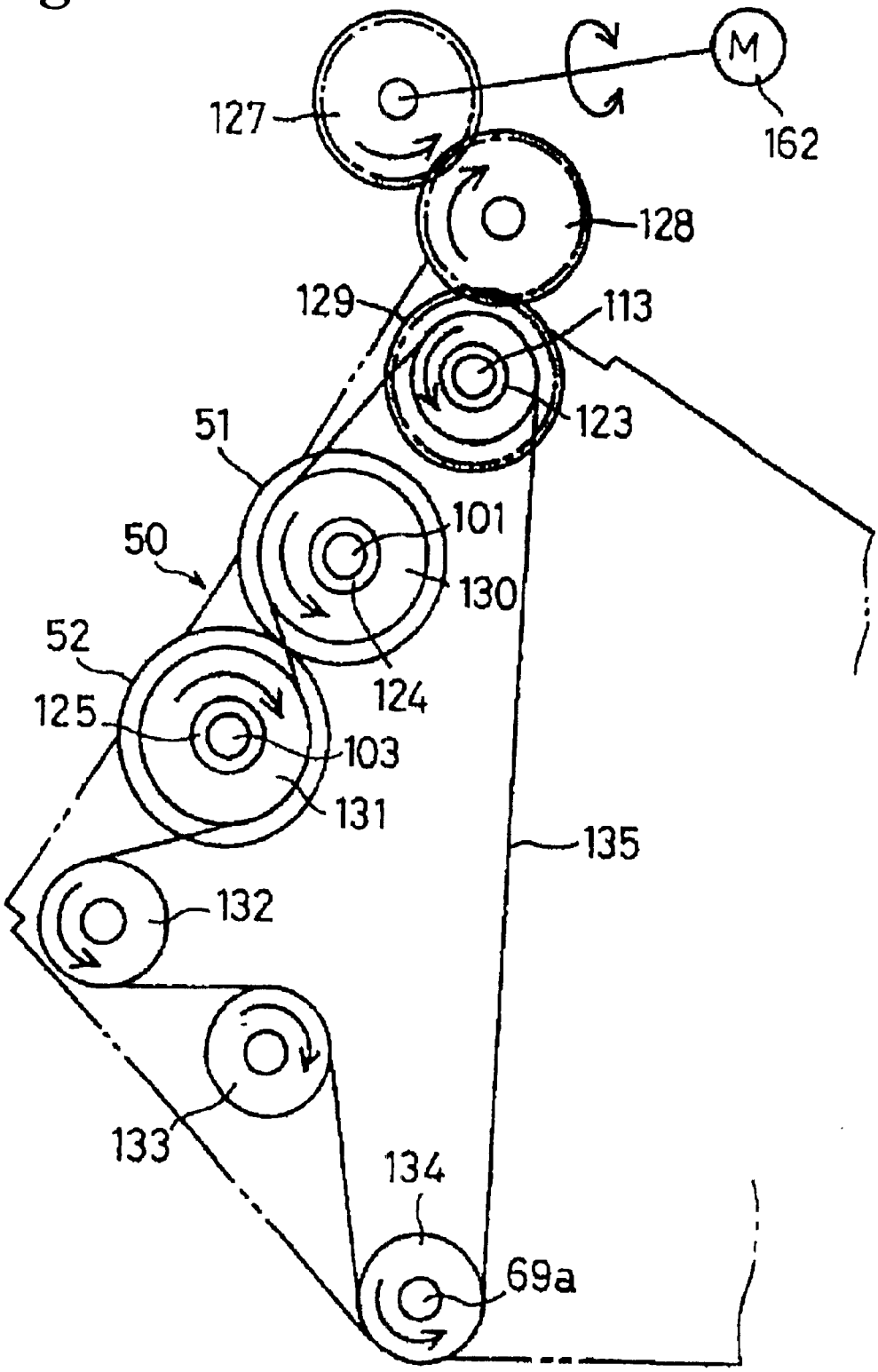
FIG. 22 is a view for a folding unit driving mechanism of the sheet post-processing apparatus.
Figure 23:
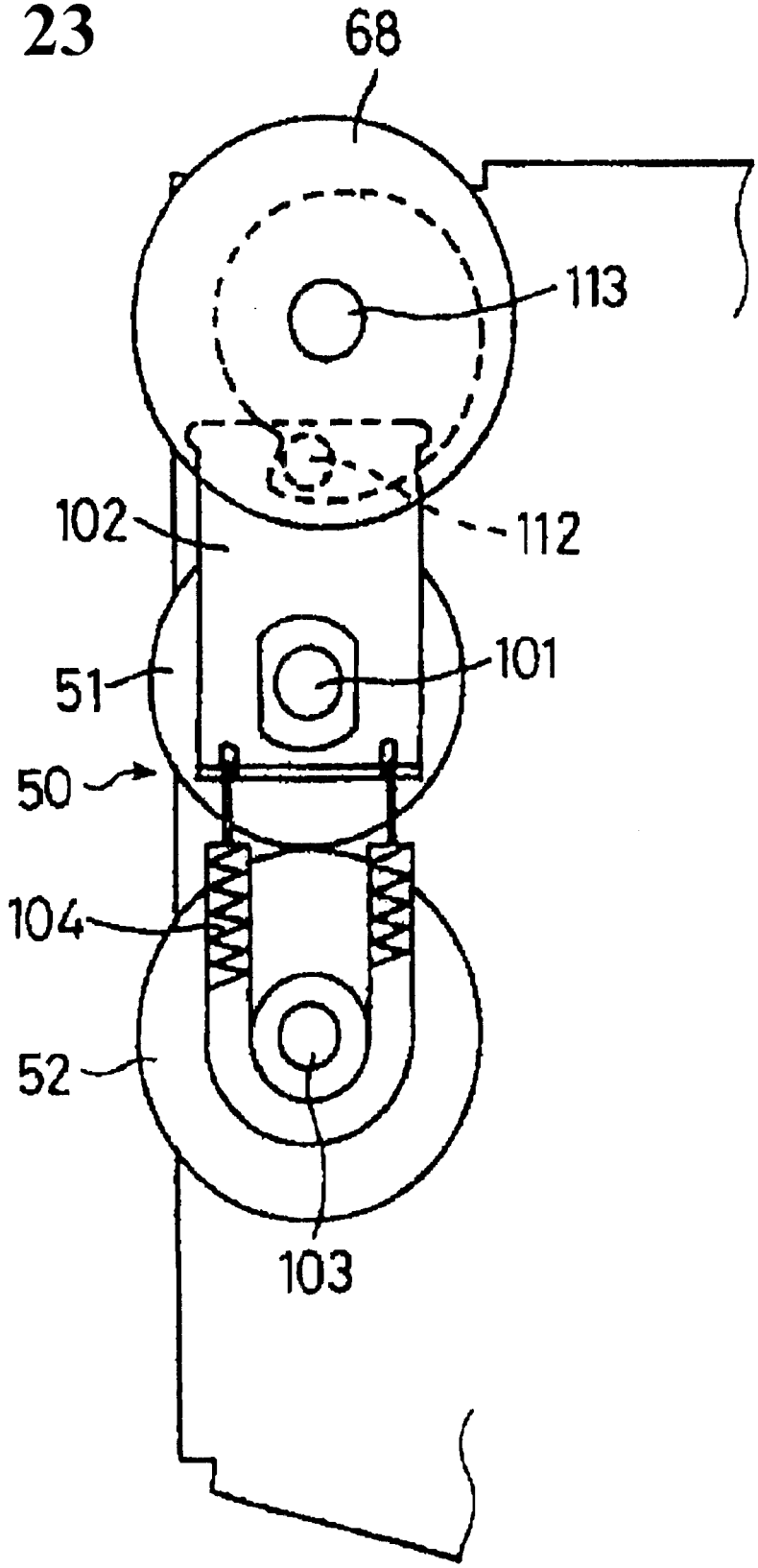
FIG. 23 is another view for the driving mechanism for the folding unit of the sheet post-processing apparatus.

The drive force for the upper stack feed roller 51 and the lower feed roller 52, as shown in FIGS. 22 and 23, is input to a gear pulley 129 on the folding unit 50 via gears 127 and 128 from a reversible feed motor 162 formed on the sheet post-processing apparatus 2. A one-way clutch 123 is interposed between the gear pulley 129 and a shaft 113 for driving the upper roller moving cam 68. This allows only one-way rotation (reverse of the direction of the arrow in FIG. 22) of the gear pulley 129 to rotate an upper roller moving cam 68 for a vertical movement of the upper stack feed roller 51. The drive force from the gear pulley 129 is transmitted via a timing belt 135 to the upper roller shaft 101 and the lower roller shaft 103 through pulleys 130 and 131. One-way clutches 124 and 125 are interposed between the pulleys 130 and 131 and the upper roller shaft 101 and the lower roller shaft 103, respectively. Driving the pulleys 130 and 131 in the direction of an arrow in FIG. 22 drives the upper roller shaft 101 and the lower roller shaft 103 to rotate. The timing belt 135 extends via idle pulleys 132 and 133 to drive the paired stack discharge rollers 60*a* and 60*b* to rotate.

When the gear pulley 129 shown in FIG. 22 rotates in the direction of the arrow, the upper stack feed roller 51 and the lower feed roller 52 rotate in a direction to feed the sheet bundle into the folding unit 50. When the gear pulley 129 rotates in the reverse direction of the arrow shown, as described above, the upper roller moving cam 68 rotates to make the upper stack feed roller 51 separate from or press to the lower feed roller 52. Those actions are controlled with a sensor or the like detecting a flag projection (not sown) formed at the shaft 113.

Figure 24:
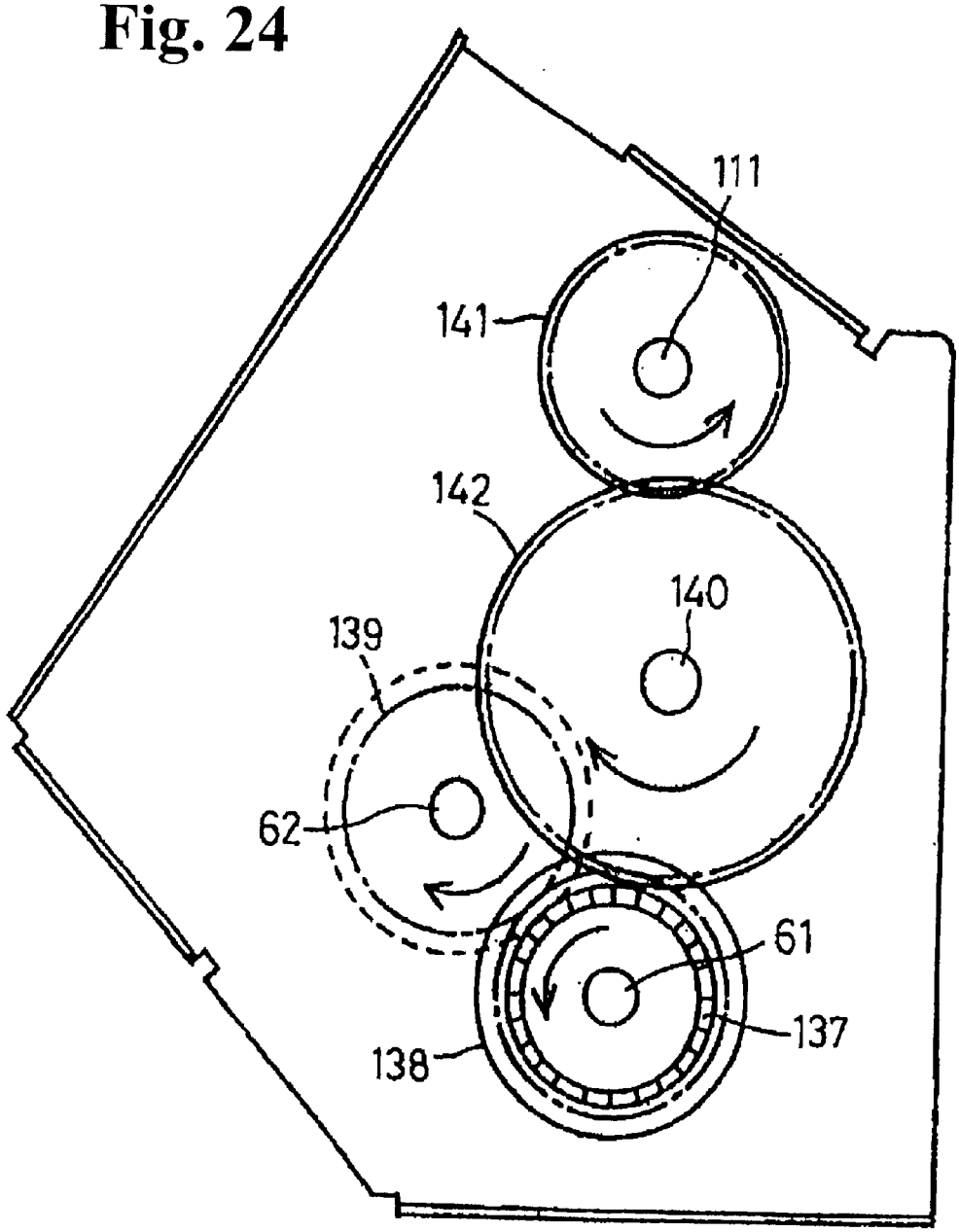
FIG. 24 is another view for the driving mechanism for the folding unit of the sheet post-processing apparatus.

FIG. 24 illustrates the drive force transmission system for the paired folding rollers 57*a* and 57*b,* formed on the back frame for the drive system shown in FIGS. 22 and 23.

The drive force for a staple/folding motor 170 (FIG. 8) from the sheet post-processing apparatus 2 is received by a coupling device 137. Normal rotation (not shown) of the staple/folding motor 170 drives the coupling device 44 of the stapler unit in FIG. 16, while the reverse rotation of the staple/folding motor 170 rotates the coupling device 137.

The drive force from the coupling device 137 is transmitted via a gear 138 formed on the folding roller drive shaft 61 to a gear 130 for rotating the folding roller 57*a* (FIG. 21) and to a gear 142. The drive force from the gear 142 is transmitted via a gear 141 to the fixed frame 111 to drive the cam plate 114 to actuate the actuating arm 115 thereby moving the abutting plate 55. It should be noted that the position of the cam plate 114 can be known by detecting a flag projection fixed at the fixed frame 111 with a sensor (not shown).

Figure 25B:
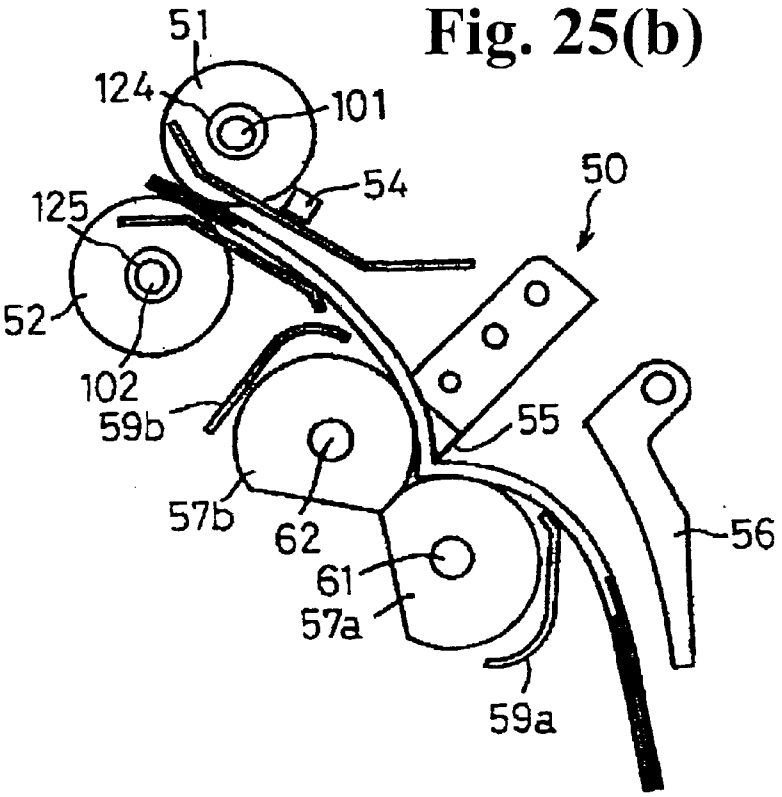
FIG. 25(*a*) is an operational view for folding a sheet stack by an abutting plate of the folding unit before folding the sheet, and FIG. 25(*b*) is an operational view during folding of the sheet.
Figure 25A:
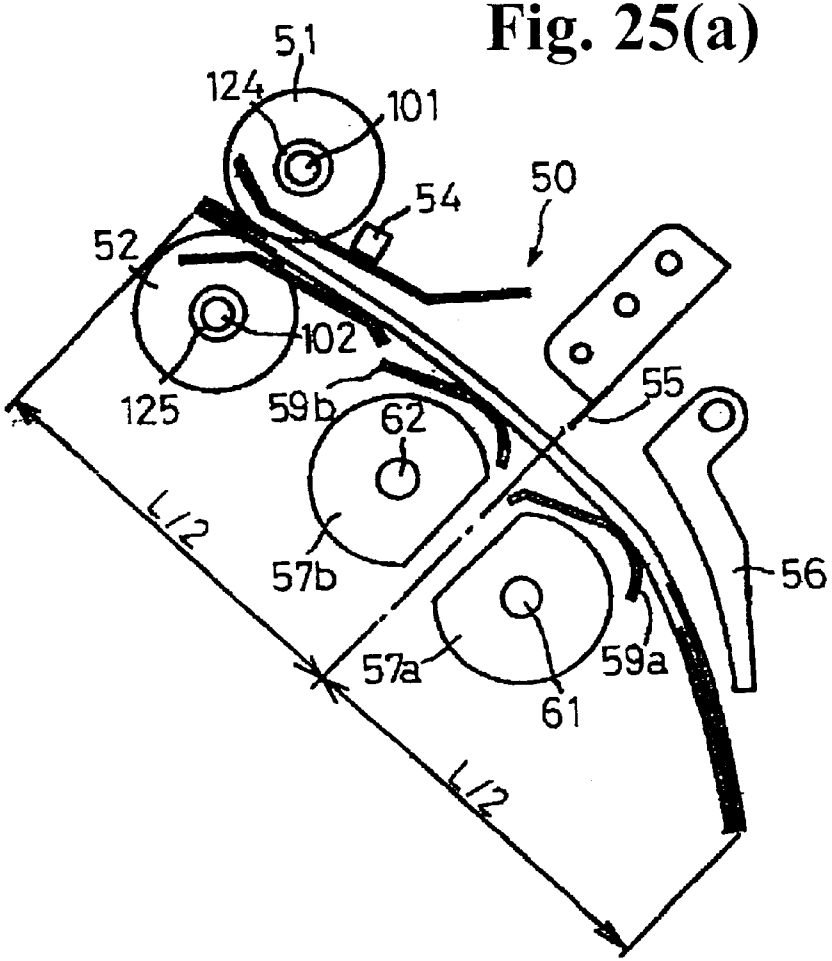

Next, the following describes the sheet folding operation on the folding unit 59 by referring to FIGS. 25(*a*) and 25(*b*).

Sheets are fed by the upper stack feed roller 51 separated from the lower feed roller 52 to saddle-stitch the sheet bundle in the processing tray 8 around the center in the feed direction thereof. The leading edge of the sheet bundle then is detected and saddle stitching is performed in the middle in the feed direction of the sheet bundle. The upper roller moving cam 68 (FIG. 20) then s rotated to press the upper stack feed roller 51 against the lower feed roller 52 to drive until the middle of the sheet stack fed in the sheet feed direction comes right below the abutting plate 55.

The backup guides 59*a* and 59*b* then are located to cover the outside surfaces of the folding rollers 57*a* and 57*b*, and back up, or support, the bottom of the sheet bundle. The sheet bundle, therefore, can be fed smoothly. When the approximate middle of the sheet bundle in the feed direction comes to right below the abutting plate 55, the stack detecting sensor 54 detects the bundle and makes the upper stack feed roller 51 and the lower feed roller 52 stop from driving once. In such a state, the sheet bundle is hung down by the upper stack feed roller 51 and the lower feed roller 52 as shown in FIG. 25(*a*).

This causes the sheet bundle to align itself under its own weight. It is advantageous that with the sheet bundle hanging down, the abutting plate 55 needs only a sheet path downstream thereof without any mechanism, such as a sheet stopper. It is also advantageous that the folding unit 59 and the whole sheet post-processing apparatus 2 can be made compact because the portion downstream from the abutting plate 55 is inclined downward.

At the point where the sheet bundle comes to the state shown in FIG. 25(*a*), the folding roller drive shaft 61 is rotated. With the folding roller drive shaft 61 rotated, the paired folding rollers 57*a* and 57*b* are both rotated. The cam plate 114 (FIG. 21) also is rotated to move the abutting plate 55 to the nip of the paired folding rollers 57*a* and 57*b*. The paired folding rollers 57*a* and 57*b* rotate while folding the sheet bundle and delivering it into the sheet bundle stacking tray 80.

When the abutting plate 55 pushes a half (middle, L/2) of length (L) of the sheet bundle into between the paired folding rollers 57*a* and 57*b*, the upper roller shaft 101 of the upper stack feed roller 51 and the lower roller shaft 103 of the lower feed roller 52 leave stopped. As the one-way clutches 124 and 125 are interposed between the upper stack feed roller 51 and the shaft 101, and between the lower feed roller 52 and the shaft 102, respectively (FIG. 22), however, the upper stack feed roller 51 and the lower feed roller 52 can be pulled to follow the rotation by the sheet bundle, thus not preventing the sheet bundle from being folded, while the sheet bundle is folded by the abutting plate 55. The sheet bundle, therefore, can be folded smoothly by the paired folding rollers 57*a* and 57*b*. The sheet bundle is then discharged from the folding unit 50 to the sheet bundle stacking tray 80 as the upper stack feed roller 51 and the lower feed roller 52 are rotated and also the paired stack discharge rollers 60*a* and 60*b* are rotated.

FIG. 8 is the block diagram depicting for control operation of the sheet post-processing apparatus 2. The control block 149 comprises a central processing unit (CPU), a ROM for storing control means in advance that the CPU executes, and RAM for storing the operational data of the CPU and control data received from the main body 1 of the copier 20.

The control block 149 has I/O devices formed therein. Arrows directing toward the control block 149 indicate input, and arrows away from the control block 149 indicate output.

A circuit for aligning the sheets has a front aligning HP sensor 151 and a rear aligning HP sensor 152 for setting a home position (HP) of the aligning plates 9 that can align both ends of the sheets in the processing tray 8. The aligning plates 9 (FIG. 3) are idle at the positions of the front aligning HP sensor 151 and the rear aligning HP sensor 152 until the first sheet is fed into the processing tray 8. A front aligning motor 14 is a pulse motor for moving the front aligning plate 9, and a rear aligning motor 14 is a pulse motor for moving the rear aligning plate 9. The aligning motors 14 move the respective aligning plates 9 to align the width of the sheet bundle according to the width thereof. The aligning plates 9 can freely move for a specified volume of the sheet bundles in the direction traversing the feed direction.

In turn, a circuit for the elevator tray 90 comprises a paper sensor 93 for detecting a top surface of the sheets thereon, a elevation clock sensor 150 for detecting the number of rotations of an elevator tray motor 155 with an encoder, and an upper limit switch 153 and a lower limit switch 154 to limit an elevation range for the elevator tray 90. The circuit for the elevator tray 90 controls the elevator tray motor 155 with signals input from the sensors 93 and 159 and the switches 153 and 154 to drive the elevator tray 90.

A circuit for detecting whether or not a sheet or sheet bundle is stacked on the elevator tray 90 in the sheet bundle stacking tray 80, is equipped with an elevator tray paper sensor 156 for detecting the presence on the elevator tray 90 and a folded sheet bundle paper sensor 157 that is a detecting sensor in the sheet bundle stacking tray 80. These sensors 156 and 157 also are used as sensors for issuing alarms to an operator if any sheet remains before the sheet post-processing apparatus 2 is started or if a sheet bundle is not removed after a predetermined time elapses.

A circuit for a door open-close detection for detecting the opening of a door of the sheet post-processing apparatus 2 and whether or not the main body 1 of the image forming apparatus 20 has the sheet post-processing apparatus 2 mounted has a front door sensor 158, and a joint switch 150 for detecting whether or not the main body 1 of the image forming apparatus 20 has the sheet post-processing apparatus 2 mounted correctly.

The circuit for the sheet feed operation and the sheet bundle feed operation with sheets stacked comprises a sheet detecting sensor 4 for detecting on the feed guide 3 that a sheet is fed from the main body 1 of the copier 20 to the sheet post-processing apparatus 2, a processing tray sheet detecting sensor 160 for detecting the presence of a sheet on the processing tray 8, a center stitching position sensor 95 and a center stitching and folding position sensor 95' for detecting a leading end of the sheet bundle in the feed direction to detect the same position for folding the sheets as the staple driven position, a pushing pawl sensor 76 for detecting a home position of the pushing pawl 13 formed on the feed belt 12 for transferring the sheet bundle on the processing tray 8 toward the elevator tray 90, and an upper stack feed roller HP sensor 161 for detecting the home position at which the upper stack feed roller 51 at an inlet of the folding unit 50 is separated from the lower feed roller 52. The circuit can control the feed motor 162 and the stepping motor 70 according to signals from the respective sensors. The rotating force of the feed motor 162 is transmitted to the paired feed rollers 5, the paired discharge rollers 6, the upper stack feed roller 51, the lower feed roller 52, and the paired stack discharge rollers 60*a* and 60*b*.

The reverse rotation of the feed motor 162 turns the upper roller moving cam 68 to move the paired stack feed rollers 51. The rotating force of the stepping motor 70 is transmitted to the lower feed roller 18 and the upper feed roller 19 formed on the processing tray 8 and the first pulley 10 to circulate the feed belt 12.

The circuit for controlling the paddle 17 comprises a paddle HP sensor 163 to detect the rotating position of the paddle 17 and an upper feed HP sensor 164 to detect the position where the upper feed roller 19 is separated from the lower feed roller 18, thereby controlling a paddle motor 165 according to signals from the sensors 163 and 164.

The circuit for controlling the staple/folding operation is comprised of a staple HP sensor 166 to detect that the driving head unit 31 and the anvil unit 32 in the saddle stitching unit 30 can drive staples, a staple sensor 167 to detect whether or not the driving head unit 31 has staples set therein, a staple slide HP sensor 168 to detect whether or not the sheet bundle is at a home position (FIG. 16) when it is started to move in the sheet feed direction between the driving head unit 31 and the anvil unit 32, a staple/folding clock sensor 171 to detect the rotation direction of a staple/folding motor 170 that can switch the drives of the saddle stitching unit 30 and the folding unit 50 to normal or reverse, and a safety switch 172 for detecting that the saddle stitching unit 30 and the folding unit 59 are operable. The circuit having the sensors and switches mentioned above controls the stapler slide motor 42 and the staple/folding motor 170.

The stapler slide motor 42 transmits the rotating force to the screw shaft 36 to move the driving head unit 31 and the anvil unit 32 in the direction traversing the sheet feed direction. The staple/folding motor 170 is arranged to drive the coupling device 44 (FIG. 16) for the saddle stitching unit 30 in one of the normal and reverse rotation directions or the coupling device 137 (FIG. 24) for the folding unit 50 in the other rotation direction.

Next, the following describes the operations in the process modes of the sheet post-processing apparatus 2.

Three basic processing modes include:

(1) Non-staple mode: a mode for stacking sheets onto the elevator tray 90 without stitching;

(2) Side staple mode: a mode for saddle-stitching the sheets at one or a plurality of positions on an end (side) thereof in the sheet feed direction before stacking the sheets onto the elevator tray 90.

(3) Saddle step mode: a mode for stitching the sheets at a plurality of positions on a half length of sheet in the sheet feed direction and for folding and binding the sheets at the stitched positions before stacking the sheets onto the sheet bundle stacking tray 80.

(1) Non-Staple Mode

With this mode selected, the control block 149 drives the stepping motor 70 to circulate the feed belt 12 to move the pushing pawl 13 at the home position (HP in FIG. 15) to the pre-home position (Pre HP in FIG. 15) that is a sheet stacking reference position on the processing tray 8 before stopping.

At the same time, the control block 149 drives the feed motor 162 to rotate the paired feed rollers 5 and the paired discharge rollers 6, and waits for a sheet to be discharged from the discharge rollers 1*a* and 1*b* of the main body 1 of the copier 20. When the sheet is discharged, the paired feed rollers 5 and the paired discharge rollers 6 feed the sheet to the processing tray 8. The sheet detecting sensor 4 detects the sheet, and measures start timings of the aligning motors 14 for the aligning plates 9 and the paddle motor 165 for rotating the paddle 17.

The control block 149 drives the aligning motors 14 and the paddle motor 165 while the sheet is discharged and stacked onto the processing tray 8. With the drive, the aligning plates 9 move in the width direction traversing the sheet feed direction to align both ends of the sheet, and the paddle 17 is rotated to make one end of the sheet strike the pushing pawl 13 at the Pre HP position to align the sheets. This operation is repeated every time the sheet is discharged to the processing tray 8. If a predetermined number of sheets is aligned to the pushing pawl 13, the control block 149 stops the feed motor 162 and the paddle motor 165 from rotating, and also restarts the stepping motor 70 for driving the feed belt 12. With this operation, the sheet bundle is moved to the elevator tray 90 (direction of the arrow A in FIG. 3). The moved sheet bundle is stacked on the elevator tray 90.

Along with the discharge of the sheet bundle, the control block 149 makes the elevator tray motor 155 move down to a certain distance in a downward direction of the elevator tray 90 once. Subsequently, it drives the elevator tray motor 155 upward until the paper sensor 93 detects the top sheet before stopping, and makes the elevator tray motor 155 idle until the following sheet bundle is placed thereupon.

(2) Side Staple Mode

When the side staple mode is selected, the control block 149 drives the feed motor 162 to rotate the paired feed rollers 5 and the paired discharge rollers 6 to deliver a sheet from the main body 1 of the copier 20 to the processing tray 8 to stack. The control block 149 also drives the aligning motors 14 and the paddle motor 165 while the sheet is discharged and stacked. With that operation, the sheet is aligned on both ends in the width direction thereof by the aligning plates 9, and the leading end of the sheet is transferred to the stopper 21 to stop. This operation is repeated for a specified number of sheets.

In the state where the sheet bundle is restricted by the stopper 21, the upper feed roller 19 is moved to the lower feed roller 18 to make the upper feed roller 19 and the lower feed roller 18 nip the sheet bundle.

At that time, the driving head unit 31 and the anvil unit 32 are both positioned at the staple home position shown in FIG. 16.

The staple home position is a position where one-position stitching is made on the left unit frame 41 shown in FIG. 16, that is, on the back side of the copier 20 and the sheet post-processing apparatus 2 shown in FIG. 1. In more detail, the position is determined by a specific number of pulses from the HP sensor (not shown) located on the left unit frame 41 side shown in FIG. 16.

When the one-position stitching is specified, the control block 149 makes the staple/folding motor 170 to rotate in the staple moving direction to make the driving head unit 31 and the anvil unit 32 proceed with stitching. It should be noted that to stitch the sheets at a plurality of positions on the ends thereof, the stapler slide motor 42 must be driven to move the driving head unit 31 and the anvil unit 32 from the staple home position to a desired staple position before proceeding with stitching.

After the stitching process is finished, the stitched sheet bundle is moved to the elevator tray 90 side (direction of the arrow A in FIG. 3) with the lower feed roller 18, upper feed roller 19, and the feed belt 12 driven by the stepping motor 70. This delivers the sheet bundle to the lower feed roller 18, the upper feed roller 19, and pushing pawl 13 in this order to stack it onto the elevator tray 90. The operation of the elevator tray 90 is the same as in the non-staple mode described above, so that the explanation is omitted.

(3) Saddle Staple Mode

This mode stitches and folds around the center position of the sheet length in the sheet feed direction. Because the stacking of the sheets discharged from the main body 1 onto the processing tray 8 is similar to that of the side staple mode of operation described above, the description is omitted.

After the sheets are aligned and stacked on the processing tray 8, the upper feed roller 19 is moved down to the lower feed roller 18 side to make the upper feed roller 19 and the lower feed roller 18 nip the sheet bundle. In turn, the stopper 21 is retracted from the feed path 25 before the control block 149 drives the stapler slide motor 42 to transfer the sheet bundle in the arrow B direction in FIG. 3. The drive allows the stopper engaging projection 24 on the driving head unit 31 also to move as shown in FIGS. 4, 5, 25 and 26 to engage the moving arm 23 to retract the stopper 21 from an area where the driving head unit 31 and the anvil unit 32 are located.

It should be noted that the stopper 21 may be alternatively repositioned by a single wide stopper 421 (FIG. 4) or a plurality of stoppers 221 (FIG. 5) extending in the direction in which the driving head unit 31 moves along the guide rod 34, the direction being a direction traversing or orthogonal to the direction in which the sheets are discharged from the copier 20 to the sheet post-processing apparatus 2 or a direction traversing or orthogonal to the direction in which the sheet bundle is fed in the sheet bundle feed path. By the engagement of the stopper engaging projection 24 of the driving head unit 31 with the moving arm 23, all the stoppers are retracted from the moving area of the driving head unit 31 and the anvil unit 32 to open the sheet bundle feed path.

The stopper engaging projection 24 is formed in the driving head unit 31 in the embodiment described above. Alternatively, the stopper engaging projection 24 can be formed at the anvil unit 32 so as to retract the stopper from the moving area of the driving head unit 31 and the anvil unit 32 to open the sheet stack feed path.

In such a structure, the driving head unit 31 and the anvil unit 32 move from the home staple position shown in FIG. 16 along the guide rod 34 to open the sheet bundle feed path before stopping at the driving set positions in the direction traversing the sheet moving direction.

The stopping positions of the driving head unit 31 and the anvil unit 32, however, can be specifically controlled to change depending on the difference of an alignment reference with the aligning plate 9, and the difference of the sheet size, as will be described later.

The control block 149 rotates the stepping motor 70 in a direction reverse to the non-staple and side staple modes. This drive makes the sheet bundle feed in the direction reverse (direction of the arrow B in FIG. 3) to the elevator tray 90. When in the feeding, the stack detecting sensor 54 in the folding unit 50 detects the leading edge of the sheet bundle in the feed direction, the upper feed roller 19 and the lower feed roller 18 feed the sheet bundle and stop it at a position where the approximate middle position in the sheet feed direction coincides with the stitching position according to the sheet length information in the feed direction sent in advance.

It should be noted that if the stepping motor 70 rotates in the reverse direction, the one-way clutch 75 interposed between the first pulley 10 and the first pulley shaft 10*a* for connecting the feed belt 12 prevents the rotating force of the stepping motor 70 from transmitting but maintains the feed belt 12 and the pushing pawl 13 stopped at the home position.

Next, the control block 149 rotates the staple/folding motor 170 to drive the drive shaft 38 and the anvil drive shaft 37 rotate in the directions for operation to stitch. When there is a plurality of stitchings at a plurality of positions, the stapler slide motor 42 is driven to rotate the screw shafts 35 and 36 to move to specific positions in a direction traversing the sheet feed direction before stitching.

After saddle-stitching the sheet bundle at the plurality of positions, the driving head unit 31 and the anvil unit 32 are moved from the final stitching position to the home staple position shown in FIG. 16 along the guide rod 34. This disengages the stopper engaging projection 24 of the driving head unit 31 from the moving arm 23, makes the stoppers 21 (421 or 221) return to the moving area of the driving head unit 31 and the anvil unit 32, closes the feed path 25, and prepares for alignment of the leading edge of subsequent sheets.

Accordingly, in a stroke of the driving head unit 31 and the anvil unit 32 moving from the staple home position to the staple position and returning to the staple home position again, the position for saving the stopper 21 (421 or 221), the position for stitching process, the position for the stopper to return in the feed path 25, and the position for a guide 370 (which will be described later) to guide the sheet bundle are already set.

Figure 26:
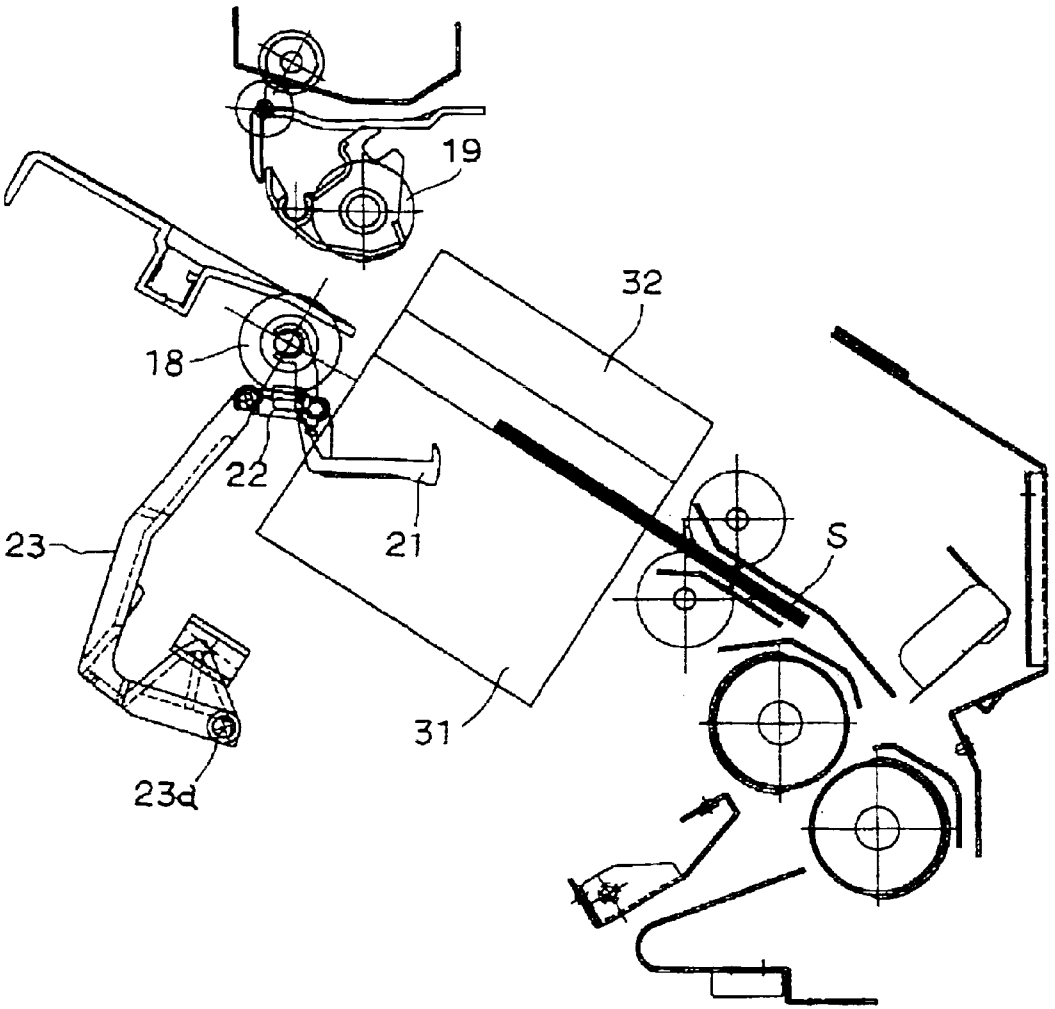
FIG. 26 is a cross-sectional view for the stopper in relation to the sheet stack when the stopper is returned to a restricting position.

It should be noted that timing when the stopper 21 (421 or 221) is returned from the position where the driving head unit 31 and the anvil unit 32 perform the saddle stitching for the final sheet stack into the feed path 25 is not required to wait until the sheet stack having saddle-stitching finished is entirely delivered from the sheet post-processing apparatus 2. When the trailing end of the sheet stack S in the feed direction has passed the stopper 21 as shown in FIG. 26, for example, the stopper 21 (421 or 221) can be moved to the position to return into the feed path 25.

Therefore, alternatively, the driving head unit 31 and the anvil unit 32 can start to move at an instance when the driving head unit 31 and the anvil unit 32 reach a position to return the stopper 21 after the trailing end of the sheet bundle has passed the stopper 21, the instance being decided with respect to a size of the sheet, a sheet bundle feed speed, and other factors. Such a scheme quickens the preparations for accepting a next sheet bundle.

Figure 27:
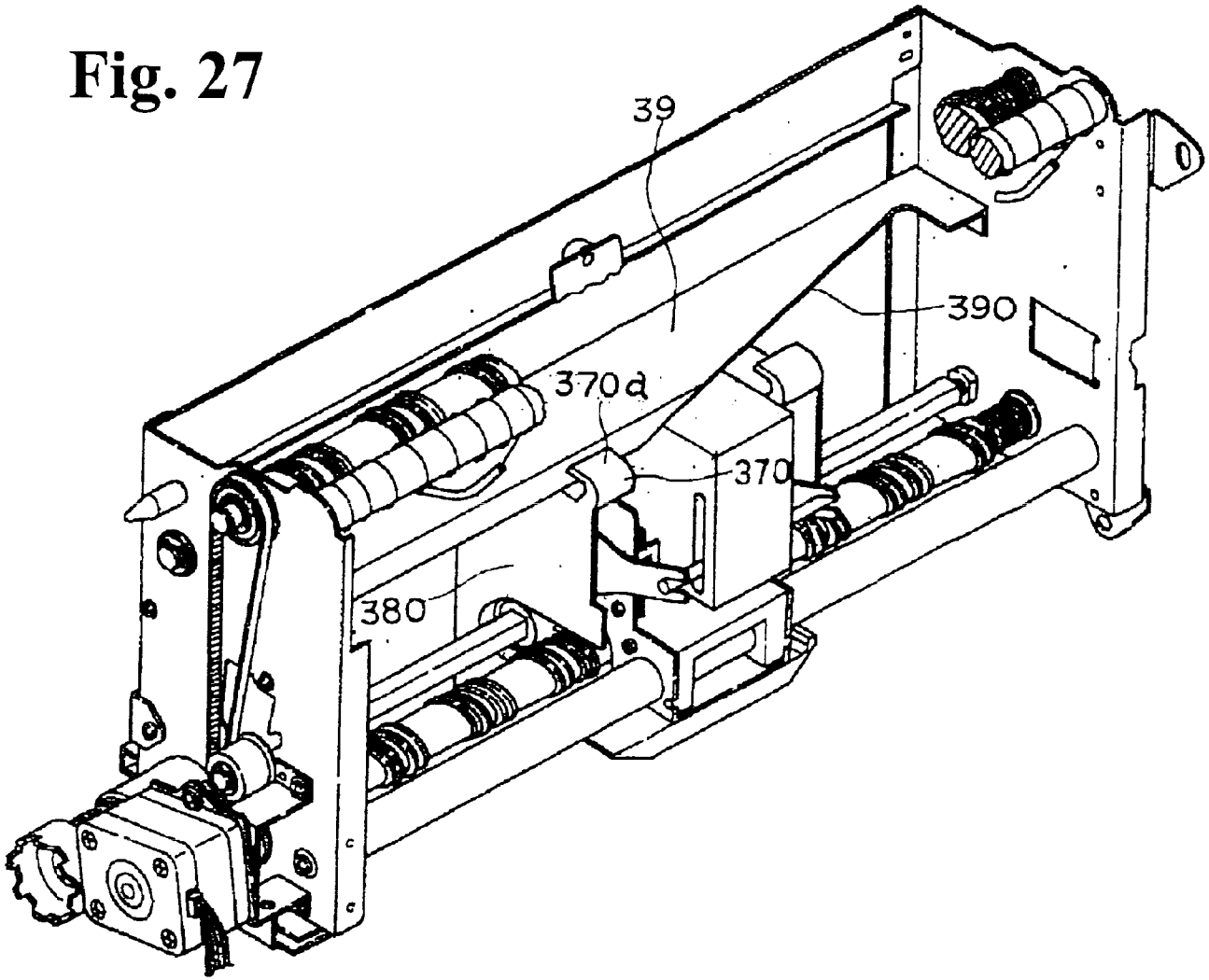
FIG. 27 is a perspective view for showing a relationship between a feed guide and a pre-guide.
Figure 28:
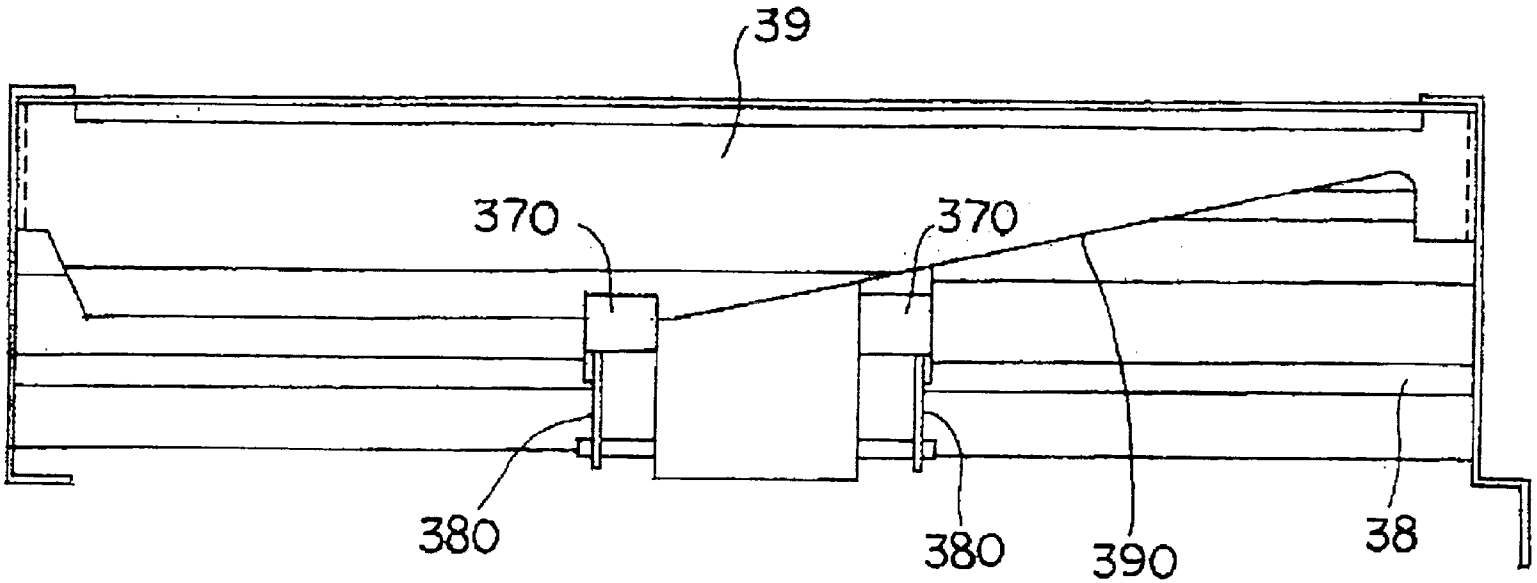
FIG. 28 is a plan view for showing a relationship between the feed guide and the pre-guide.

In the embodiment, also, the driving head unit 31 formed upstream of the fixed feed guide 39, as shown in FIGS. 27 and 28, has a cover 380 fixedly disposed on both ends thereof. The cover 380 has the pre-guide 370 on a top thereof. The pre-guide 370 has a slope 370*a* to deviate the leading end of the sheet stack away from the upstream end of the fixed feed guide 39. Those means prevent the leading end of the sheet stack from being caught by the upstream end of the fixed feed guide 30 so as not to destroy the posture of the sheet stack and to prevent the sheets from buckling thereby ensuring the correct saddle stitching.

The pre-guide 370 is positioned more inwardly of the feed path 25 with respect to the fixed feed guide 39 as shown in FIG. 27 to prevent the leading edge of the sheet stack from getting caught by the upstream edge of the fixed feed guide 39. Furthermore, the downstream edge of the pre-guide 370 and the upstream end of the fixed feed guide 39 are overlapped each other in the feed direction of the sheet stack, as shown in FIGS. 27 and 28, to prevent the leading edge of the sheet stack from entering thereinto.

When the sheet bundle aligned by the aligning plates 9 with reference to a center in the width direction is fed to the fixed feed guide 39, the pre-guide 370 moves to the center position in the width direction which is common to the sheets or to a position close thereto, for example, to the stitching position together with the driving head unit 31. Such control guides the sheet bundle into the feed guide with good balance.

When the sheet bundle aligned with reference to either right or left edge of a sheet in a width direction thereof by the aligning plate 9 is fed into the fixed feed guide 39, a center position of the sheet differs for the size of the sheet.

Therefore, the pre-guide 370 moves to the center position in the width direction according to the size of the sheet or to the position close thereto together with the driving head unit 31. Such control guides the sheet bundle into the feed guide with good balance.

In the embodiment, the pre-guide 370 is fixed to the driving head unit 31 and is movable together with the driving head unit 31. Alternatively, the pre-guide 370 itself may move independently.

In the embodiment, the pre-guide 370 is formed on the drive head unit 31 as seen from the sheet stack since a leading edge of the sheet stack curled on the side of the drive head unit 31 disposed on a printing side of the sheets tends to get caught by the upstream edge of the feed guide 39 because curling usually occurs on the leading edge of the sheet. Alternatively, as the feed guide may be attached to the anvil unit 32, the pre-guide 370 may be placed on the side of the anvil unit 32 as seen from the sheet stack.

The fixed feed guide 39 has a cutout portion 390 on the upstream edge thereof as shown in FIGS. 27 and 28. The cutout portion 390 is effective in guiding the ends of the sheet bundle smoothly along a guide surface of the fixed feed guide 39 according to feeding of the sheet bundle, wherein the ends are not guided by the pre-guide 370.

With such means, the sheet bundle led to the fixed feed guide 39 by the pre-guide 370 can be firmly supported and guided in the width direction by the fixed feed guide 39 before being saddle-stitched by the driving head unit 31 and the anvil unit 32. This ensures the correct saddle stitching on the sheet bundle.

It should be noted that when the sheet bundle has been fed to the stitching position, the position of the leading edge of the sheet bundle in the feed direction has already passed over the lower feed roller 52 in the folding unit 59 and the upper stack feed roller 51 separated from the lower feed roller 52.

After the stitching is finished, folding is performed as follows. First, the feed motor 162 shown in FIG. 22 rotates in reverse to rotate the upper roller moving cam 68 shown in FIGS. 20 and 23. With the rotation, the bearing holder 102 is moved to move the upper stack feed roller 51 down to the lower feed roller 52 side to make the tension spring 104 nip the sheet bundle.

In turn, the upper feed roller 19 in the processing tray 8 is moved upward from the sheet bundle to release the sheet bundle from nipping. Now, the upper stack feed roller 51 and the lower feed roller 52 are driven by the feed motor 162 to feed the sheet bundle further downstream. In feeding, the feed motor 162 speed is reduced to stop according to a signal from the stack detecting sensor 54 and sheet length information when the sheet bundle comes to an approximate center in the feed direction, that is, when the stitched position becomes the folding position. The sheet bundle is hung down in the feed path by being nipped between the upper stack feed roller 51 and the lower feed roller 52.

The staple/folding motor 170 then is driven in a direction reverse to the stitching process to rotate the paired folding rollers 57*a* and 57*b* in the directions of nipping the sheet bundle and to move the abutting plate 55 down as shown in FIG. 21(*b*). At the same time, the backup guides 59*a* and 59*b* are moved to release the surfaces of the folding rollers on the sheet bundle side. After the abutting plate 55 has moved the paired rotating folding rollers 57*a* and 57*b* having the sheet bundle nipped therebetween, the sheet bundle is rolled in between the paired folding rollers 57*a* and 57*b*. In succession, while the abutting plate 55 moves in the direction away from the sheet bundle, the sheet bundle is further folded in by the paired folding rollers 57*a* and 57*b*. At the stage, the feed motor 162 rotates the upper stack feed roller 51, the lower feed roller 52, and the paired stack discharge rollers 60*a* and 60*b* in the directions of delivering the sheet bundle into the sheet bundle stacking tray 80. The paired folding rollers 57*a* and 57*b* are stopped when the abutting plate 66 moves and is detected by the abutting plate HP sensor 160. The sheet bundle nipped and fed by the paired stack discharge rollers 60*a* and 60*b* is discharged to and stacked on the sheet bundle stacking tray 80. The folded sheet bundle is held down by the folded sheet holder 81 so that it does not open, thereby not preventing a subsequent folded sheet bundle from being fed in.

It should be noted that the upper stack feed roller 51 separates from the lower stack feed roller 52, moves up, and prepares to feed the next sheet bundle when a period of time available for the paired stack discharge rollers 60*a* and 60*b* to deliver the sheet bundle has elapsed.

In FIGS. 12 and 14, there are formed the recess 82 for absorbing the expansion of the folded side of the sheet bundle formed on the bottom 80*a* of the sheet bundle stacking tray 80 (discharge tray) and the stack stopper (stopper member) 83 that can be tilted in the direction of the arrow as urged virtually upright by the spring 84 with the rotating shaft 83*a* formed in the vicinity of the outlet of the sheet bundle stacking tray 80 as a fulcrum.

For the sheet bundles P discharged by the paired stack discharge rollers 60*a* and 60*b,* as shown in FIG. 13, the expanded portions Pa thereof on a folded side are dropped into the recess 82 to ease the thickness difference of the expanded portions Pa and open ends Pb thereof, thereby allowing the sheet bundles to be stacked substantially horizontal on the sheet bundle stacking tray 80. In such a way, the folded sheet stacking device 79 can stack the sheet bundles in a stable state, thereby increasing stackability.

With the sheet bundles stacked sequentially in the sheet bundle stacking tray 80, as shown in FIG. 14, the sheet bundles are moved in a sheet bundle discharge direction (leftward in the drawing) with contact resistance among the sheet bundles. The stack stopper 83 is pressed by the sheet bundles to resist the spring 84 to open outwardly. The expanded portions Pa of the sheet bundles then are deviated outward, thereby easing the thickness difference of the expanded portions Pa and the open ends Pb. It should be noted that the folded sheet stacking device 79 can lower the stacking height of the whole sheet bundles to stack the sheet bundles in a stable manner.

Figure 29A:
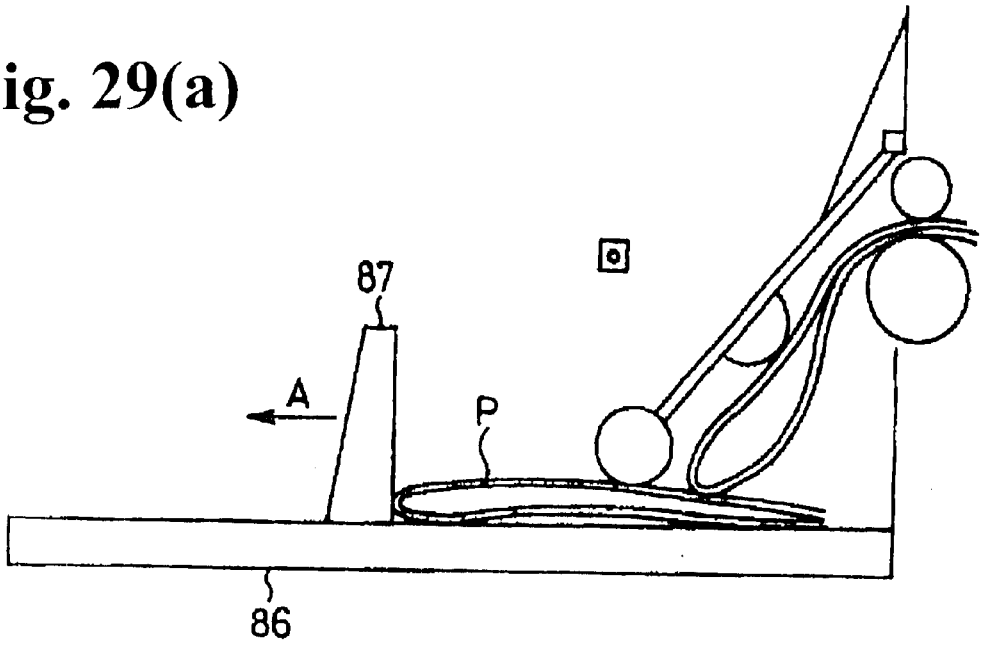
FIG. 29(*a*) is a front view of a conventional folded sheet bundling device when a small amount of folded sheets is loaded, and FIG. 29(*b*) is a front view thereof when a large amount of folded sheets is loaded.
Figure 29B:
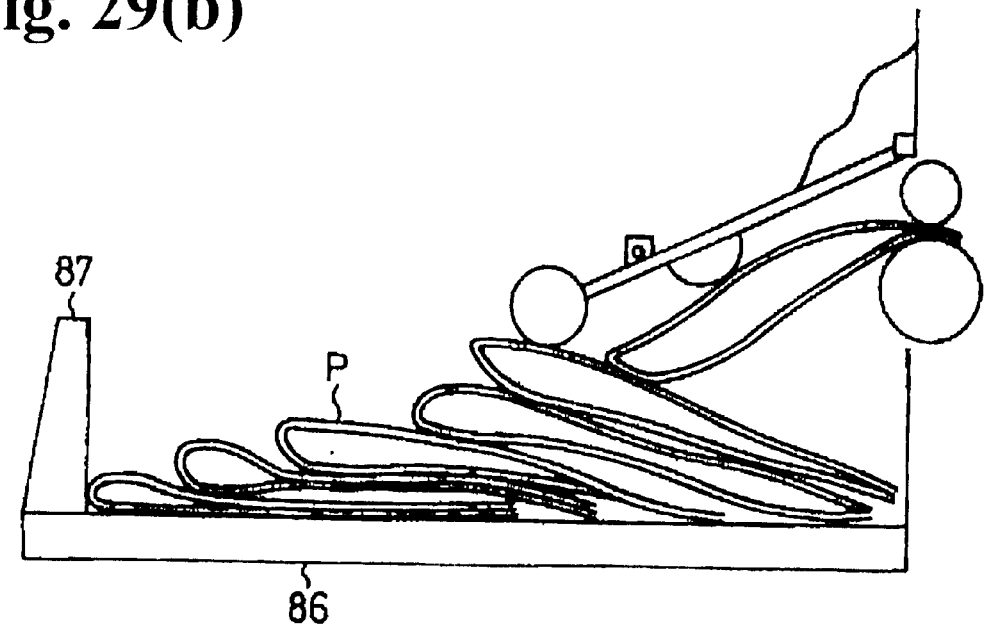

In addition, a side of the expanded portions Pa of the stacked sheet bundles abuts the stack stopper 83 to restrict the amount of movement to take a shape along the inclined stack stopper 83. Therefore, the sheet bundles, unlike in a usual discharge tray 86 shown in FIG. 29, are less in the amount of movement, thus making the stacking space narrower. Further, the open ends Pb of the sheet bundles stacked already can not be turned over by a sheet bundle discharged newly as the sheets stacks are moved away, which results in no wrinkles or bends in the sheet bundles.

Figure 30:
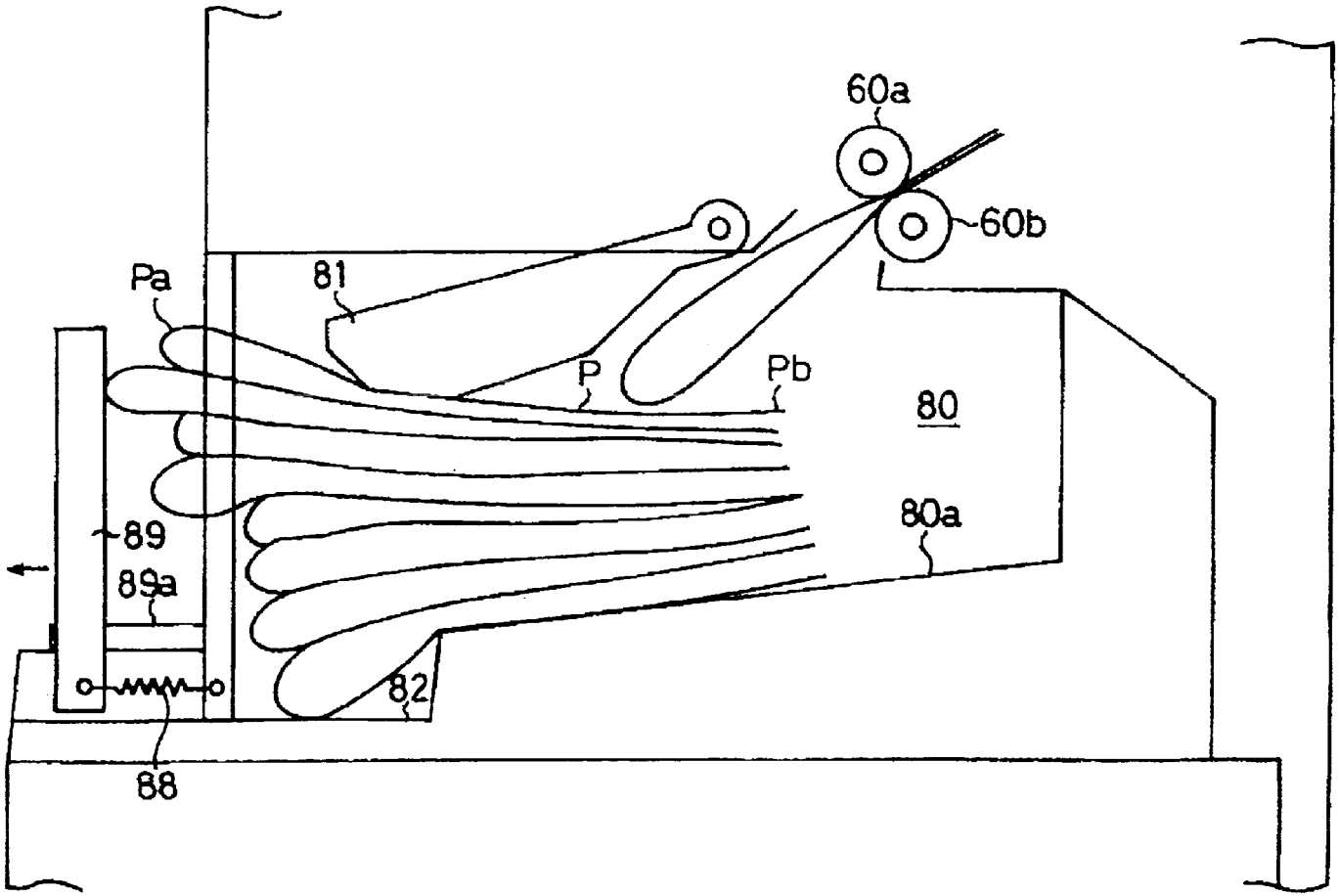
FIG. 30 is a front cross-sectional view for the sheet stacking device.

The stack stopper 83 in the embodiment can incline obliquely. Alternatively, as shown in FIG. 30, a stack stopper (stopper member) 89 may be formed to resist the tension spring 88 to move linearly on a guide rail 89*a*. In such an arrangement, also, a similar effect can be obtained by using the stack stopper 83.

The sheet bundles can be taken out freely as the stack stoppers 83 and 89 are inclined or moved. Further, the stack stoppers 83 and 89 are set at a home position which allows the folded sheets of maximum size to be taken out. With such a setting, the folded sheets of any size can be free of jutting out of the sheet bundle stacking tray 80, not turned over, before being stacked.

In the saddle stitch mode in the embodiment described above, the stitching process and the folding process are made consecutively. It should be noted that only the folding process can be performed without the stitching process. Furthermore, the folded sheet stacking device 79 can stack thereon only the sheet bundles folded but not stitched.

While the invention has been explained with reference to the specific embodiments of the invention, the explanation is illustrative and the invention is limited only by the appended claims.

What is claimed is:

1. A sheet post-processing apparatus comprising:

stacking means for stacking sheets discharged sequentially from an image forming apparatus;

at least one leading edge restricting member movable between a restricting position to restrict a leading edge of a sheet discharged to the stacking means in a sheet discharge direction and a retracted position to retract from the restricting position;

a head unit movably disposed in a direction traversing the sheet discharge direction to provide staples into a sheet bundle;

an anvil unit arranged at a side to face the head unit and movably disposed in the direction traversing the sheet discharge direction to receive and bend staples driven from the head;

a feed path disposed between the head unit and the anvil unit for allowing the sheet bundle to pass therethrough;

feeding means for feeding the sheet bundles from the stacking means to the feed path, said head unit and said anvil unit stitching the sheet bundles fed for a specified distance into the feed path by the feeding means; and means for moving said at least one leading edge restricting member between said restricting position and said retracted position by moving at least one of said head unit and said anvil unit in a direction traversing said sheet discharge direction.

2. A sheet post-processing apparatus according to claim 1, wherein during a reciprocating stroke of the head unit and the anvil unit moving from a home position in a direction traversing the sheet discharge direction to said home position again, said head unit and anvil unit have a first position where the moving means moves said at least one leading edge restricting members from the restricting position to the retracted position; a second position where said moving means moves said at least one leading edge restricting members from said retracted position to said restricting position; and a staple position where stitching is performed on the sheet bundle.

3. A sheet post-processing apparatus according to claim 1, further comprising sheet discharge means for discharging the sheet bundle stitched by said head unit and said anvil unit from between said head unit and said anvil unit, a time where at least one of said feeding means and said sheet discharge means feeds the sheet bundle and a time where at least one of said head unit and said anvil unit moves in the direction traversing the sheet discharge direction overlapping each other.

4. A sheet post-processing apparatus according to claim 2, further comprising sheet discharge means for discharging the sheet bundle stitched by said head unit and said anvil unit from between said head unit and said anvil unit, a time where at least one of said feeding means and said sheet discharge means feeds the sheet bundle and a time where at least one of said head unit and said anvil unit moves in the direction traversing the sheet discharge direction overlapping each other.

5. A sheet post-processing apparatus according to claim 2, further comprising sheet discharge means for discharging the sheet bundle stitched by said head unit and said anvil unit from between said head unit and said anvil unit, at least said head unit and said anvil unit starting to move from said staple position to a second position before at least one of said feeding means and said sheet discharge means moves a trailing edge of said sheet bundle past said leading edge restricting member.

6. An image forming apparatus comprising control means for controlling a movement of at least one of said head unit and said anvil unit of the sheet post-processing apparatus according to claim 1.

7. An image forming apparatus comprising control means for controlling a movement of at least one of said head unit and said anvil unit of the sheet post-processing apparatus according to claim 2.

8. An image forming apparatus comprising control means for controlling a movement of at least one of said head unit and said anvil unit of the sheet post-processing apparatus according to claim 3.

9. An image forming apparatus comprising control means for controlling a movement of at least one of said head unit and said anvil unit of the sheet post-processing apparatus according to claim 4.

10. An image forming apparatus comprising control means for controlling a movement of at least one of said head unit and said anvil unit of the sheet post-processing apparatus according to claim 5.

11. A sheet post-processing apparatus comprising:

stacking means for stacking sheets discharged sequentially from an image forming apparatus;

at least one leading edge restricting member movable between a restricting position to restrict a leading edge of a sheet discharged to the stacking means in a sheet discharge direction and a retracted position to retract from the restricting position;

a head unit movably disposed in a direction traversing the sheet discharge direction to provide staples into a sheet bundle;

an anvil unit arranged at a side to face the head unit and movably disposed in the direction traversing the sheet discharge direction to receive and bend staples driven from the head;

a feed path disposed between the head unit and the anvil unit for allowing the sheet bundle to pass therethrough;

feeding means for feeding the sheet bundles from the stacking means to the feed path, said head unit and said anvil unit stitching the sheet bundles fed for a specified distance into the feed path by the feeding means; and sheet discharge means for discharging said sheet bundle stitched by said head unit and said anvil unit from between said head unit and said anvil unit, wherein a time in which at least one of said feeding means and said sheet discharge means feeds the sheet bundle and a time in which at least one of said head unit and said anvil unit moves in the direction traversing said sheet discharge direction overlap each other.

12. An image forming apparatus comprising control means for controlling a movement of at least one of said head unit and said anvil unit of the sheet post-processing apparatus according to claim 11.

* * * * *